US009229352B2

(12) United States Patent
Yamazaki

(10) Patent No.: US 9,229,352 B2
(45) Date of Patent: Jan. 5, 2016

(54) IMAGE FORMING APPARATUS THAT CONTROLS CORRECTION OF IMAGE FORMING POSITIONS AND METHOD OF CONTROLLING THE SAME

(71) Applicant: CANON KABUSHIKI KAISHA, Tokyo (JP)

(72) Inventor: Katsuyuki Yamazaki, Toride (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 13/871,369

(22) Filed: Apr. 26, 2013

(65) Prior Publication Data

US 2013/0286134 A1 Oct. 31, 2013

(30) Foreign Application Priority Data

Apr. 27, 2012 (JP) ..... 2012-102875
Apr. 17, 2013 (JP) ..... 2013-086665

(51) Int. Cl.
*G03G 15/043* (2006.01)

(52) U.S. Cl.
CPC ..... *G03G 15/043* (2013.01)

(58) Field of Classification Search
CPC ..... G03G 15/043; B41J 2/435
USPC ..... 347/236, 118, 246
See application file for complete search history.

(56) References Cited

U.S. PATENT DOCUMENTS 8,294,745 B2 10/2012 Yamashita
8,723,907 B2 5/2014 Takezawa
2008/0124125 A1* 5/2008 Hirano ..... 399/151
2009/0003862 A1* 1/2009 Tominaga ..... 399/51
2010/0231962 A1* 9/2010 Sakai et al. ..... 358/1.15
2011/0043594 A1* 2/2011 Yamashita ..... 347/246

FOREIGN PATENT DOCUMENTS

CN 102193388 A 9/2011
JP 1165212 A 3/1999
JP 2008126644 A 6/2008
JP 2011043757 A 3/2011

(Continued)

OTHER PUBLICATIONS

Office Action issued in CN201310156392.6 mailed on May 5, 2015.

(Continued)

*Primary Examiner* — Sarah Al Hashimi
(74) *Attorney, Agent, or Firm* — Rossi, Kimms & McDowell LLP

(57) ABSTRACT

An image forming apparatus capable of correcting light amounts of light beams which expose a photosensitive member with simple construction. The image forming apparatus includes a photosensitive drum, and a beam scanning device including a plurality of semiconductor lasers which emit light beams for exposing the photosensitive drum, and a memory which stores first correction data for correcting the light amount of each light beam in a manner associated with each of the plurality of semiconductor lasers. A CPU outputs second correction data for being commonly used in correcting the light amounts of the light beams emitted from the plurality of semiconductor lasers to the beam scanning device. A laser driver IC provided in the beam scanning device controls the light amount of the light beam emitted from each semiconductor laser based on the first correction data and the second correction data.

11 Claims, 15 Drawing Sheets

(56) References Cited

FOREIGN PATENT DOCUMENTS

| | | | |
|---|---|---|---|
| JP | 2011-158761 | A | 8/2011 |
| JP | 2011207213 | A | 10/2011 |

OTHER PUBLICATIONS

Korean Office Action issued in Korean counterpart application No. KR10-2013-0046758, dated Aug. 18, 2015.

* cited by examiner

IMAGE FORMING APPARATUS THAT CONTROLS CORRECTION OF IMAGE FORMING POSITIONS AND METHOD OF CONTROLLING THE SAME

BACKGROUND OF THE INVENTION

1. Field of the Invention

The present invention relates to an image forming apparatus and a method of controlling the same, and more particularly to control performed by an image forming apparatus of a laser scanning type, for correcting image forming positions.

2. Description of the Related Art

In general, to form a high-quality image at high speed, an image forming apparatus performs control for correcting image forming conditions. For example, for correction of non-uniform image densities on one sheet of recording medium caused by characteristics of the image forming apparatus, it is known to control the amount of laser light during image formation (shading control).

For example, a photosensitive member (photosensitive drum) has slightly different sensitivity characteristics to laser light depending on each area exposed to laser light. The non-uniformity in sensitivity characteristics to laser light in each area causes non-uniformity in density of an image formed on one sheet of recording medium. In view of this problem, when an image is formed on one sheet of recording medium, it is conventional practice to perform control for changing the amount of laser light according to a position on the photosensitive member to thereby suppress non-uniformity in image density. When correcting the amount of laser light, an exposure position of laser light on the photosensitive member is identified, in respect of a main scan direction (direction of scanning of laser light), with reference to a horizontal synchronization signal generated by detecting deflected laser light, and in respect of a sub scan direction (direction of rotation of the photosensitive member), with reference to a result of detection of a home position mark provided on the photosensitive member. The exposure position of laser light is identified based on a clock signal output from an oscillator, and the laser light is corrected to an amount associated with the identified exposure position. Light amount control data of laser light is generated by a controller provided in a body of the image forming apparatus, and is transmitted to a beam scanning device via a data communication bus (see e.g. Japanese Patent Laid-Open Publication No. 2011-158761)

However, an image forming apparatus that performs high-speed and high-resolution image formation by increasing the number of laser beams which expose the photosensitive member has a problem that the number of data communication buses is increased. A plurality of light sources (light emitting devices) which emit laser beams are different in light emission characteristics. For this reason, light amount setting data is generated for each of the plurality of light sources. The light amount setting data is stored in a storage medium (e.g. nonvolatile memory) provided in the beam scanning device. To read out the light amount setting data from the storage medium of the beam scanning device and cause the image forming apparatus to transmit to the beam scanning device the light amount setting data in combination with the above-mentioned shading data, as the light amount control data, the number of data communication buses has to be increased. If the image forming apparatus is configured to transmit the light amount control data by serial communication, the data communication takes a lot of time.

SUMMARY OF THE INVENTION

The present invention provides an image forming apparatus which solves the above-described problem, a method of controlling the same, and a storage medium.

In a first aspect of the present invention, there is provided an image forming apparatus comprising a photosensitive member, a beam scanning device including a plurality of light sources configured to emit light beams for exposing the photosensitive member, and a storage unit configured to store first correction data for correcting a light amount of the light beam, the first correction data including a plurality of data items associated with the plurality of light sources, respectively, an output unit configured to output second correction data for correcting the light amount of the light beam to the beam scanning device, the second correction data being correction data for being commonly used in correction of the light amount of the light beam emitted from each of the plurality of light sources, and a control unit provided in the beam scanning device and configured to control the light amount of the light beam to be emitted from each of the plurality of light sources, based on the first correction data including the plurality of data items associated with the plurality of light sources, respectively, which is stored in the storage unit, and the second correction data input from the output unit.

In a second aspect of the present invention, there is provided a method of controlling an image forming apparatus, including a photosensitive member and a beam scanning device including a plurality of light sources configured to emit light beams for exposing the photosensitive member, a storage unit configured to store first correction data for correcting a light amount of the light beam, the first correction data including a plurality of data items associated with the plurality of light sources, respectively, comprising outputting correction data for correcting a light amount of the light beam by a control unit provided outside the beam scanning device, the second correction data being correction data for being commonly used in correction of the light amount of the light beam emitted from each of the plurality of light sources, reading out the first correction data by the beam scanning device from the storage unit, and controlling the light amount of the light beam to be emitted from each of the plurality of light sources based on the first correction data including the plurality of data items and the second correction data input from the control unit.

According to the present invention, it is possible to correct the light amount of light beams which expose a photosensitive member, by a simple construction.

Further features of the present invention will become apparent from the following description of exemplary embodiments with reference to the attached drawings.

BRIEF DESCRIPTION OF THE DRAWINGS

FIGS. 6A and 6B are perspective views each showing an optical unit appearing in FIG. 2 in an exploded manner, in which FIG. 6A is a perspective view as viewed from a lens barrel, and FIG. 6B is a perspective view as viewed from a circuit board.

FIGS. 8A to 8D are diagrams useful in explaining an example of an image printed by the image forming apparatus shown in FIG. 1, in which FIG. 8A shows an example of a first profile corresponding to changes of the light amount of a laser beam A guided onto the photosensitive drum in the main scan direction, and a second profile corresponding to changes of the light amount of a laser beam B guided onto the photosensitive drum in the main scan direction, FIG. 8B shows an example of a third profile indicative of non-uniformity in potential characteristics between a plurality of areas on one photosensitive drum surface, FIG. 8C shows an example of a fourth profile corresponding to non-uniformity in image density caused by an optical face tangle error of a rotary polygon mirror, and FIG. 8D shows an example of a correction profile generated by superimposing the third and fourth profiles.

FIGS. 11A to 11C are diagrams useful in explaining periodic signals output from the CPU appearing in FIG. 9, in which FIG. 11A shows a drum counter clock signal which is a periodic signal for sub scan on the photosensitive drum, FIG. 11B shows a drum counter clock signal which is a periodic signal for main scan on the photosensitive drum, and FIG. 11C shows a polygon surface counter clock signal which is a periodic signal for polygon rotation.

DESCRIPTION OF THE EMBODIMENTS

The present invention will now be described in detail below with reference to the accompanying drawings showing embodiments thereof.

Figure 1:
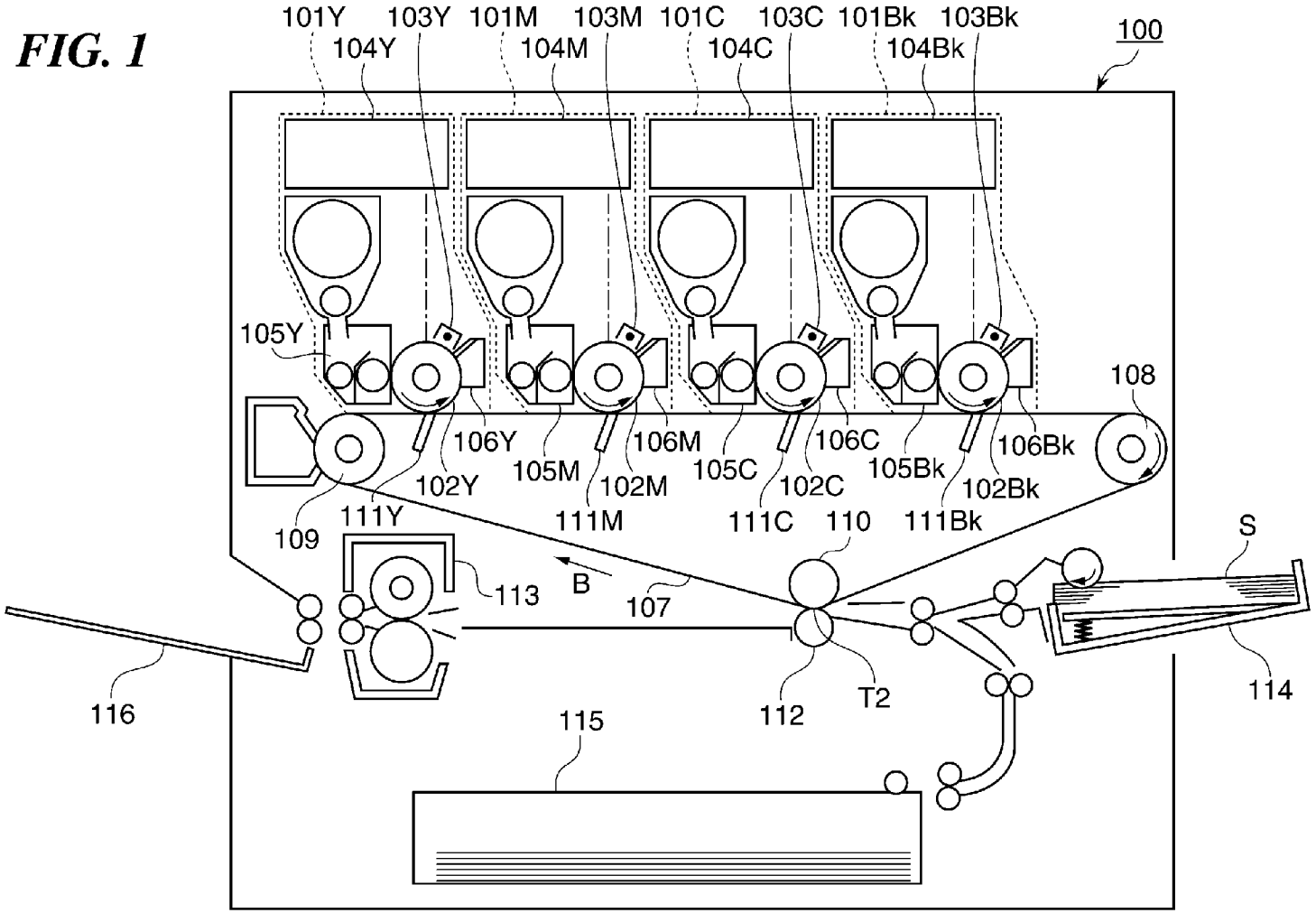
FIG. 1 is a schematic view of an image forming apparatus according to an embodiment of the present invention.

FIG. 1 is a schematic view of an image forming apparatus according to an embodiment of the present invention.

The illustrated image forming apparatus is a so-called full-color printer that forms an image using toner of a plurality of colors. Although the following description will be given of the full-color printer as an example of the image forming apparatus, the image forming apparatus may be of another type, such as a monochrome printer that forms an image using single-color toner (e.g. black).

In FIG. 1, the image forming apparatus includes image forming sections (image forming units) 101Y, 101M, 101C, and 101Bk that form images of the respective colors. In this example, the image forming sections 101Y, 101M, 101C, and 101Bk perform image formation using toner of yellow (Y), magenta (M), cyan (C), and black (Bk), respectively.

The image forming sections 101Y, 101M, 101C, and 101Bk are provided with photosensitive drums 102Y, 102M, 102C, and 102Bk, which are photosensitive members, respectively. Around the photosensitive drums 102Y, 102M, 102C, and 102Bk, there are arranged electrostatic chargers 103Y, 103M, 103C, and 103Bk, beam scanning devices 104Y, 104M, 104C, and 104Bk, and developing devices 105Y, 105M, 105C, and 105Bk, respectively.

Around the photosensitive drums 102Y, 102M, 102C, and 102Bk, there are further arranged drum cleaning devices 106Y, 106M, 106C, and 106Bk, respectively.

An intermediate transfer belt 107 which is an endless belt is arranged under the photosensitive drums 102Y, 102M, 102C, and 102Bk. The intermediate transfer belt 107 is stretched around a driving roller 108, and driven rollers 109 and 110, and is driven for rotation in a direction indicated by an arrow B in FIG. 1 during image formation. Further, primary transfer devices 111Y, 111M, 111C, and 111Bk are arranged at respective locations opposed to the photosensitive drums 102Y, 102M, 102C, and 102Bk via the intermediate transfer belt 107 (intermediate transfer member).

The image forming apparatus, denoted by reference numeral 100, is further provided with a secondary transfer device 112 for transferring a toner image on the intermediate transfer belt 107 onto a recording medium S, and a fixing device 113 for fixing the toner mage on the recording medium S.

Next, a description will be given of an image formation process from an electrostatic charging process step to a development process step, executed by the image forming apparatus 100 shown in FIG. 1. The image formation process executed by each of the image forming sections 101Y, 101M, 101C, and 101Bk is the same, and hence the image formation process executed by the image forming section 101Y will be described by way of example, and detailed description of the image formation process executed by each of the other image forming sections 101M, 101C, and 101Bk is omitted.

First, the electrostatic charger 103Y uniformly charges the surface of the photosensitive drum 102Y which is driven for rotation in a direction indicated by a solid arrow in FIG. 1. Then, the charged photosensitive drum 102Y is exposed by laser beams emitted from the beam scanning device 104Y. As a result, an electrostatic latent image is formed on the photosensitive drum 102Y. Then, the electrostatic latent image is developed by the developing device 105Y, to form a yellow toner image.

Similarly, a magenta toner image, a cyan toner image, and a black toner image are formed on the photosensitive drums 102M, 102C, and 102Bk, respectively.

Then, a transfer bias is applied to the intermediate transfer belt 107 by the primary transfer devices 111Y, 111M, 111C, and 111Bk, respectively. Then, the yellow, magenta, cyan, and black toner images on the photosensitive drums 102Y, 102M, 102C, and 102Bk are sequentially transferred onto the intermediate transfer belt 107, and the toner images of the respective colors are superimposed on the intermediate transfer belt 107. As a consequence, a color toner image is formed on the intermediate transfer belt 107.

The color toner image on the intermediate transfer belt 107 is transferred onto the recording medium S, which has been conveyed to a secondary transfer portion T2 from a manual feed cassette 114 or a sheet feeding cassette 115, by the secondary transfer device 112 (secondary transfer). Then, the color toner image on the recording medium S is heated and fixed by the fixing device 113, and the recording medium S is discharged onto a sheet discharger 116.

After completion of the first transfer, toner remaining on the photosensitive drums 102Y, 102M, 102C, and 102Bk is removed by the drum cleaning devices 106Y, 106M, 106C, and 106Bk, respectively. Thereafter, the above-described image formation process is executed.

Figure 2:
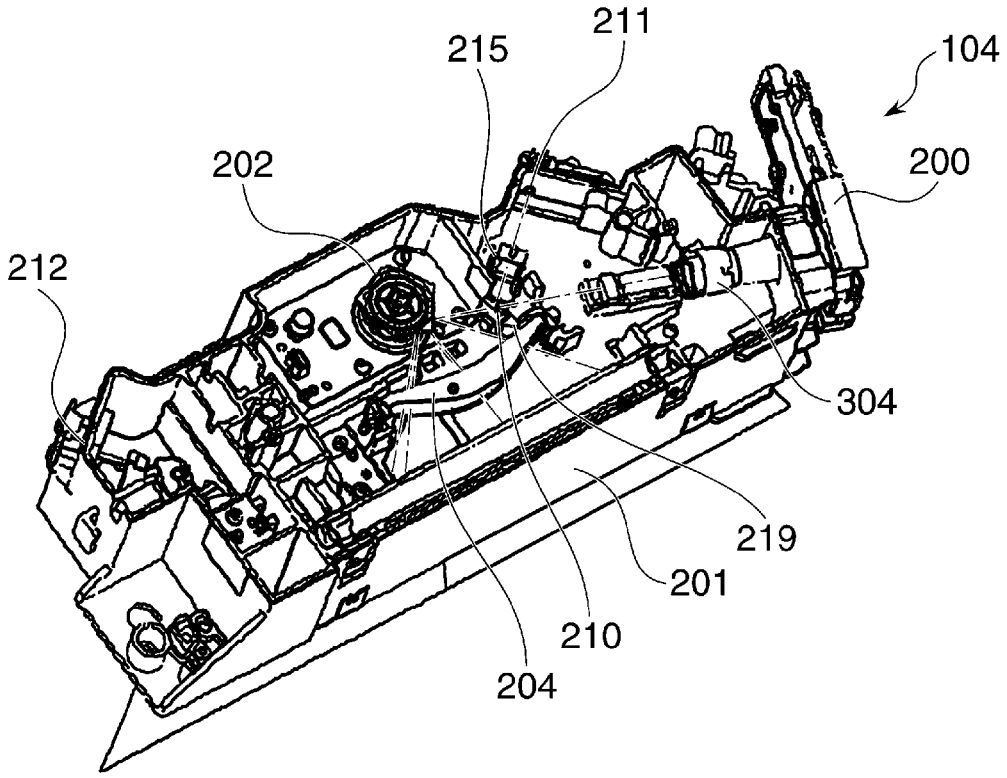
FIG. 2 is a perspective view of each beam scanning device appearing in FIG. 1.
Figure 3:
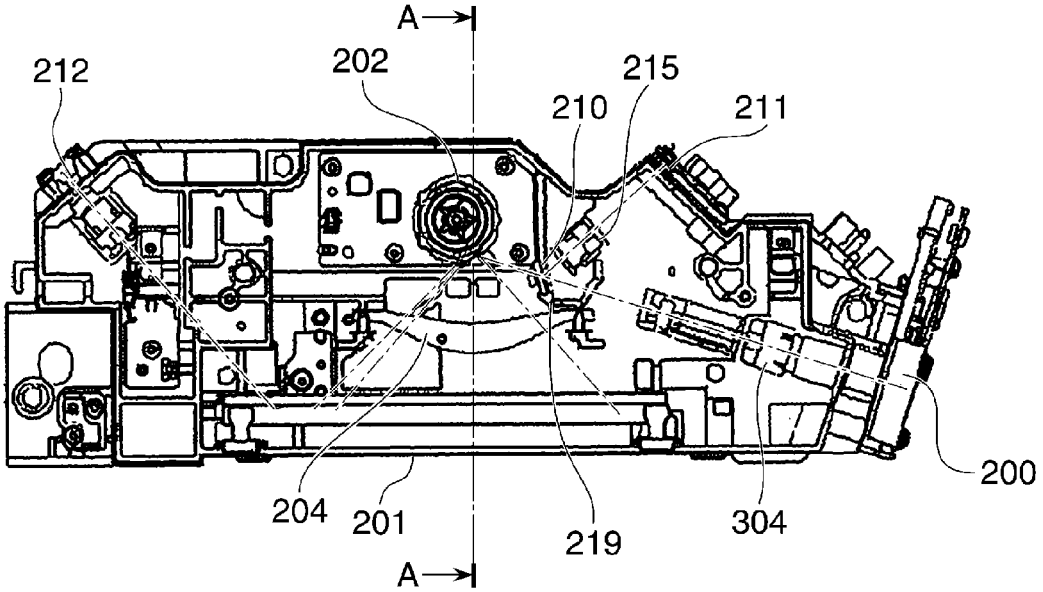
FIG. 3 is a top view of each beam scanning device.
Figure 4:
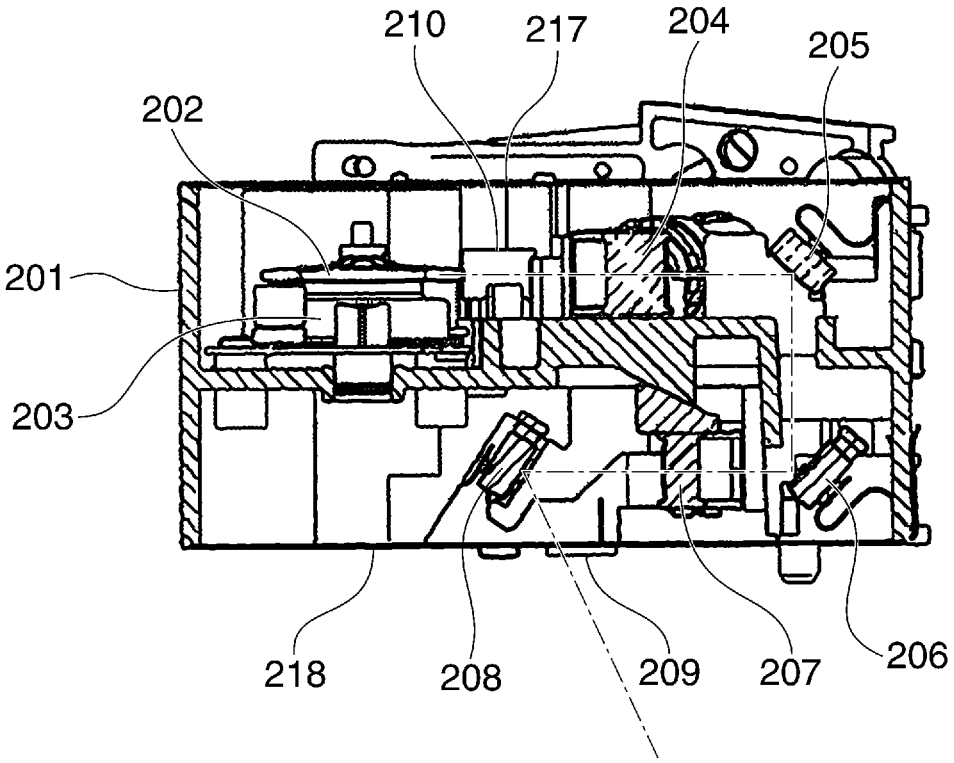
FIG. 4 is a cross-sectional view taken along A-A in FIG. 3.
Figure 5:
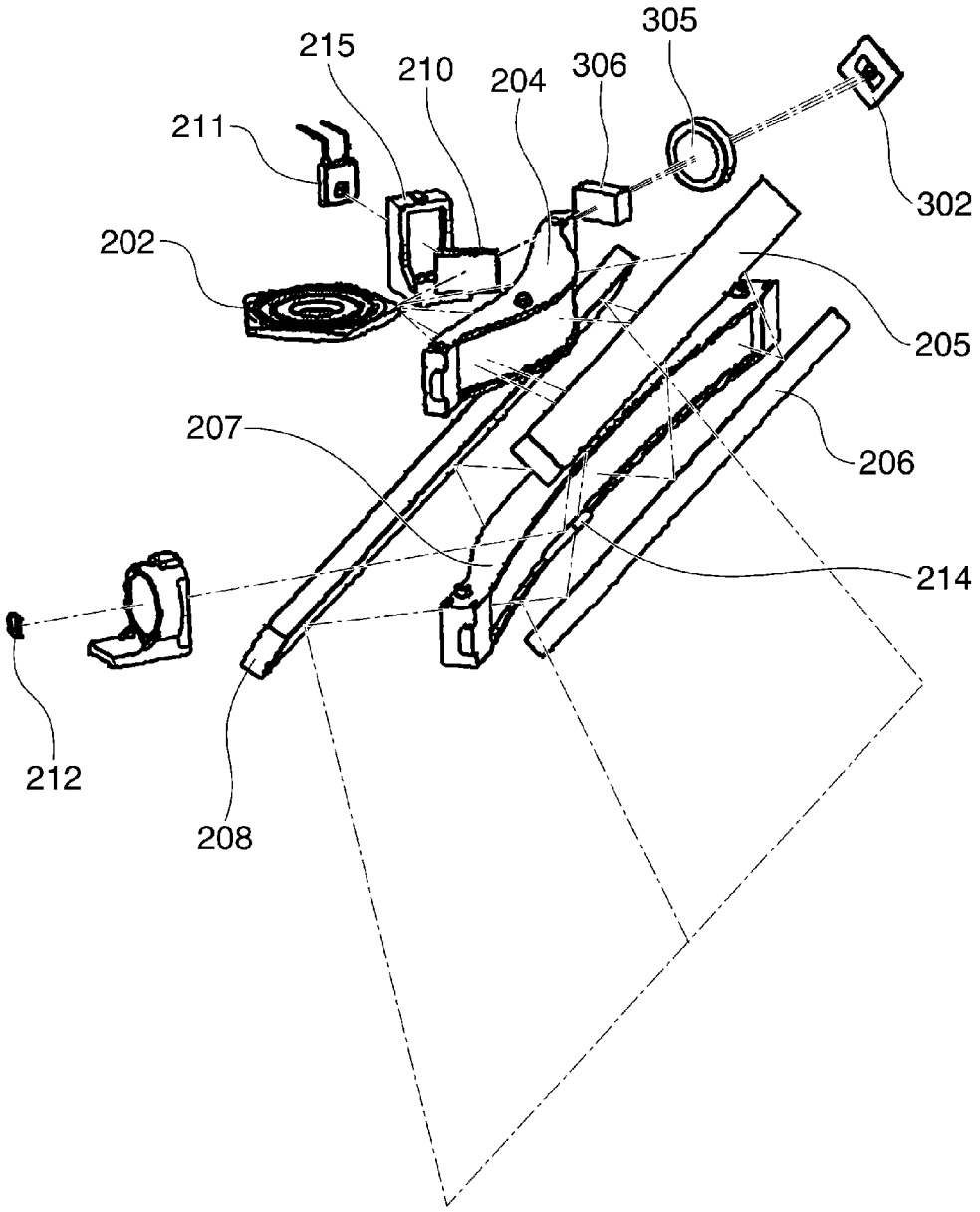
FIG. 5 is a perspective view showing the arrangement of essential optical components of each beam scanning device appearing in FIG. 1.

FIG. 2 is a perspective view of each of the beam scanning devices 104Y, 104M, 104C, and 104Bk, appearing in FIG. 1. FIG. 3 is a top view of each of the beam scanning devices 104Y, 104M, 104C, and 104Bk, appearing in FIG. 1. FIG. 4 is a cross-sectional view taken along A-A in FIG. 3. Further, FIG. 5 is a perspective view showing the arrangement of essential optical components of each of the beam scanning devices 104Y, 104M, 104C, and 104Bk, appearing in FIG. 1.

The beam scanning devices (also referred to as the laser scanner) 104Y, 104M, 104C, and 104Bk have the same construction, and hence the suffixes Y, M, C, and Bk are omitted in the following description.

The beam scanning device 104 includes an optical box 201, which accommodates the optical components. As shown in FIG. 2, an optical unit 200, described hereinafter, is mounted on the optical box 201. The optical box 201 has a rotary polygon mirror 202 disposed therein, which deflects laser beams emitted from the optical unit 200 such that the laser beams scan the photosensitive drum 102 in a predetermined direction. The rotary polygon mirror 202 is driven for rotation by a polygon motor 203 appearing in FIG. 4.

Each laser beam deflected by the rotary polygon mirror 202 enters a first fθ lens 204 (first lens). The first fθ lens 204 is positioned by a positioning section 219 provided toward an entrance surface of the first fθ lens 204 where the laser beam enters. The laser beam having passed through the first fθ lens 204 is reflected by a reflective mirror 205 and a reflective mirror 206 (see FIGS. 4 and 5), and then enters a second fθ lens 207.

The laser beam having passed through the second fθ lens 207 is reflected by a reflective mirror 208, and then is guided to the photosensitive drum 102 through a dust-proof glass 209. The laser beam scanned by the rotary polygon mirror 202 at a uniform angular velocity is caused to form an image on the photosensitive drum 102 by the first fθ lens 204 and the second fθ lens 207 (optical members), and scans the photosensitive drum 102 at a uniform velocity.

The illustrated beam scanning device 104 includes a beam splitter 210 which is a laser beam splitting unit. The beam splitter 210 is arranged on a light path of laser beams emitted from the optical unit 200 and traveling to the rotary polygon mirror 202. In the illustrated example, the beam splitter 210 is disposed between the optical unit 200 and the rotary polygon mirror 202. A laser beam having entered the beam splitter 210 is split into a first laser beam (first light beam) which is a transmitted light and a second laser beam (second light beam) which is a reflected light.

The beam splitter 210 has an entrance surface and an exit surface, and the entrance surface has a coating (film) formed thereon such that the entrance surface has a uniform reflection ratio (transmission ratio). The exit surface is slightly different in angle from the entrance surface such that even when internal reflection occurs, an internally reflected laser beam is guided in a direction different from a direction in which a second laser beam reflected by the entrance surface is guided. That is, the entrance surface and the exit surface are not parallel to each other.

The second laser beam reflected by the entrance surface of the beam splitter 210 is guided to a side opposite from the first fθ lens 204 to which the first laser beam having passed through the beam splitter 210 and reflected by the rotary polygon mirror 202 is guided.

The first laser beam is deflected by the rotary polygon mirror 202, and is guided, as mentioned hereinabove, to the photosensitive drum 102. The second laser beam passes through a collective lens 215 (second lens) appearing in FIG. 2, and then enters a photo diode (hereinafter referred to as the PD) 211 which is an optical sensor (light receiving section).

The optical box 201 has an opening formed in a side wall thereof, and the collective lens 215 is disposed on a line segment connecting the PD 211 and the beam splitter 210. The PD 211 is fitted in this opening from outside the optical box 201. The second laser beam having passed through the collective lens 215 enters the PD 211 fitted in the opening of the optical box 201.

To reduce the beam scanning device 104 in size and costs, a reflective mirror is not disposed on the light path of the second laser beam. The PD 211 outputs a light amount detection signal according to an amount of received light, and automatic power control (APC), described hereinafter, is performed based on the light amount detection signal. Note that the PD 211 may be provided within the optical box 201.

The illustrated beam scanning device 104 includes a beam detector (light receiving unit; hereinafter referred to as the BD) 212 for generating a synchronization signal for determining the timing of emitting a laser beam based on image data, in association with a location on the photosensitive drum 102. As shown in FIG. 5, the laser beam (first laser beam) deflected by the rotary polygon mirror 202 passes through the first fθ lens 204, and is reflected by the reflective mirror 205 and a reflective mirror 214, whereafter it enters the BD 212.

As shown in FIG. 5, the optical box 201 has a shape which is vertically open at top and bottom sides thereof, and hence an upper cover 217 and a lower cover 218 are attached to the optical box 201 to thereby seal the inside of the optical box 201.

Figure 6A:
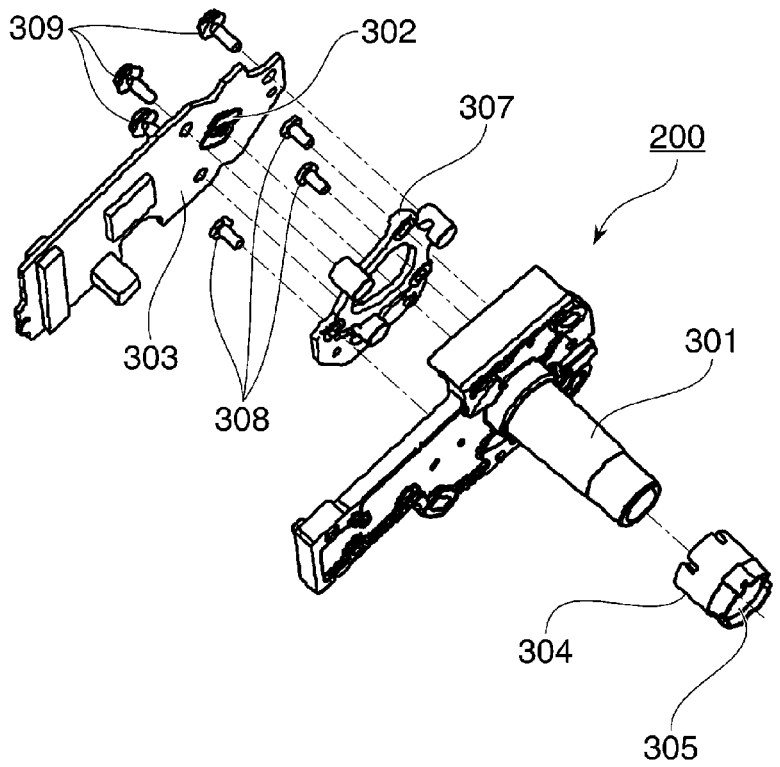
Figure 6B:
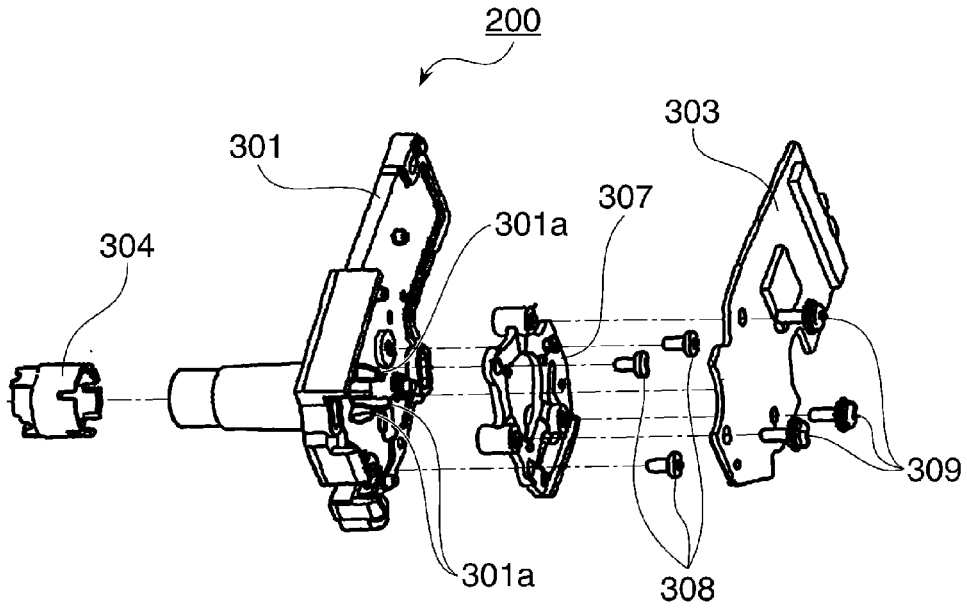

FIGS. 6A and 6B are perspective views each showing the optical unit 200 appearing in FIG. 2 in an exploded manner, in which FIG. 6A is a perspective view as viewed from a lens barrel side, and FIG. 6B is a perspective view as viewed from a circuit board side.

The optical unit 200 includes a semiconductor laser 302 (e.g. a VCSEL (Vertical Cavity Surface Emitting Laser)) as a light source for emitting laser beams (light beams). An electric circuit board (hereinafter simply referred to as the circuit board) 303 is for driving the semiconductor laser 302. In the following description, it is assumed that the semiconductor laser 302 is the VCSEL 302.

As shown in FIG. 6A, the VCSEL 302 is mounted on the circuit board 303. A laser holder 301 includes a lens barrel 304, and a collimator lens 305 is mounted on a front end of the lens barrel 304. The collimator lens 305 converts laser beams (divergent light) emitted from the VCSEL 302 into parallel light. The mounting position of the collimator lens 305 with respect to the laser holder 301 is adjusted using a predetermined jig, while detecting the irradiating position and focus of a laser beam emitted from the VCSEL 302, during assembly of the beam scanning device 104.

When the mounting position of the collimator lens 305 is determined, a ultraviolet curing adhesive applied between the collimator lens 305 and the lens barrel 304 is irradiated with ultraviolet ray to thereby adhesively fix the collimator lens 305 to the laser holder 301. The VCSEL 302 is electrically connected to the circuit board 303, and emits laser beams according to a drive signal supplied from the circuit board 303.

Next, a description will be given of how to fix the circuit board 303 having the VCSEL 302 mounted thereon to the laser holder 301.

The circuit board 303 is fixed to the laser holder 301 by a circuit board-supporting member 307. The circuit board-supporting member 307 is formed of a material having elasticity.

As shown in FIG. 6A, the circuit board-supporting member 307 is formed with three screw holes (fixing portions) in which screws 309 are screwed, and three openings through which screws 308 are inserted. The screws 309 are inserted through holes formed in the circuit board 303, and are screwed into the screw holes formed in the circuit board-supporting member 307. Further, the screws 308 are inserted through the openings of the circuit board-supporting member 307, and are screwed into screw holes formed in the laser holder 301.

To assemble the optical unit, first, the circuit board-supporting member 307 is fixed to the laser holder 301 with the screws 308. Next, the VCSEL 302 mounted on the circuit board 303 is urged against three abutment portions 301*a* (see FIG. 6B) provided on the laser holder 301. There is a space between the circuit board-supporting member 307 and the circuit board 303. Next, by fastening the screws 309, the circuit board-supporting member 307 is elastically deformed into an arch shape which is convex toward the laser holder 301. The circuit board 303 is urged against the abutment portions 301*a* by the returning force of the circuit board-supporting member 307, whereby the VCSEL 302 is fixed to the laser holder 301.

Figure 7:
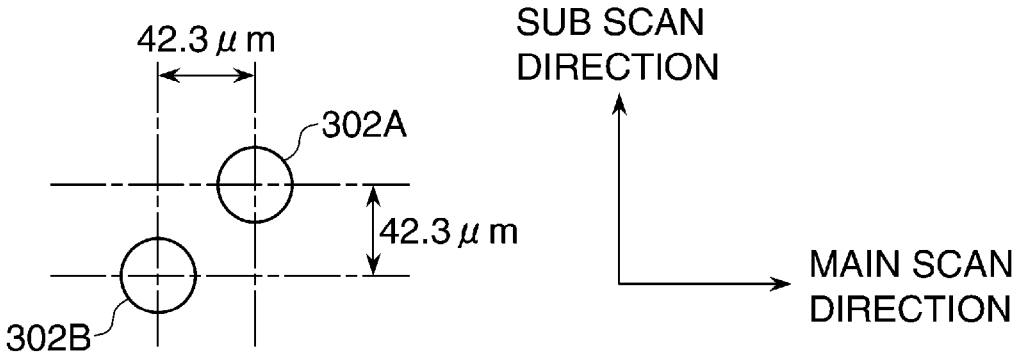
FIG. 7 is a view showing locations of laser spots formed on a photosensitive drum, irradiated by a VCSEL as a semiconductor laser appearing in FIGS. 6A and 6B.

FIG. 7 is a view showing locations of laser spots formed on the photosensitive drum 102, irradiated by the VCSEL 302 which is a semiconductor laser appearing in FIGS. 6A and 6B.

The VCSEL 302 illustrated by way of example in the present embodiment is a 2-beam laser which is tilted by 45 degrees, and is designed to project light beams from the surface of a laser chip onto the photosensitive drum 102 at the same magnification. The VCSEL 302 may have three or more light emitting devices. Each interval in sub and main scan directions between laser spots irradiated by a laser beam A (from a semiconductor laser 302A) and a laser beam B (from a semiconductor laser 302B) is 600 dpi (42.3 μm), and the VCSEL 302 is mounted on the circuit board 303 such that emission from the laser beam A precedes that from the laser beam B in respect of both main scan and sub scan. The BD signal is always acquired based on the scanning light from the laser beam A.

Next, a description will be given of four kinds of non-uniformity in image density coped with in the first embodiment.

Figure 8A:
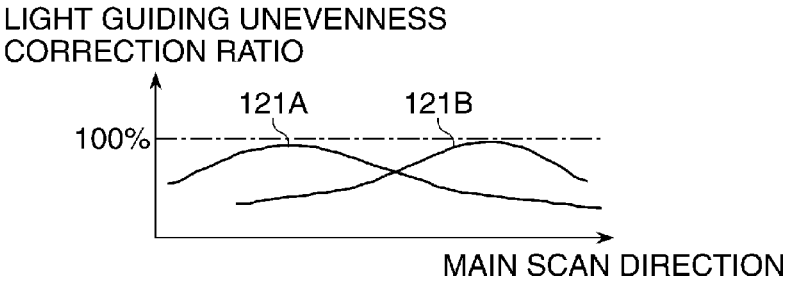
Figure 8B:
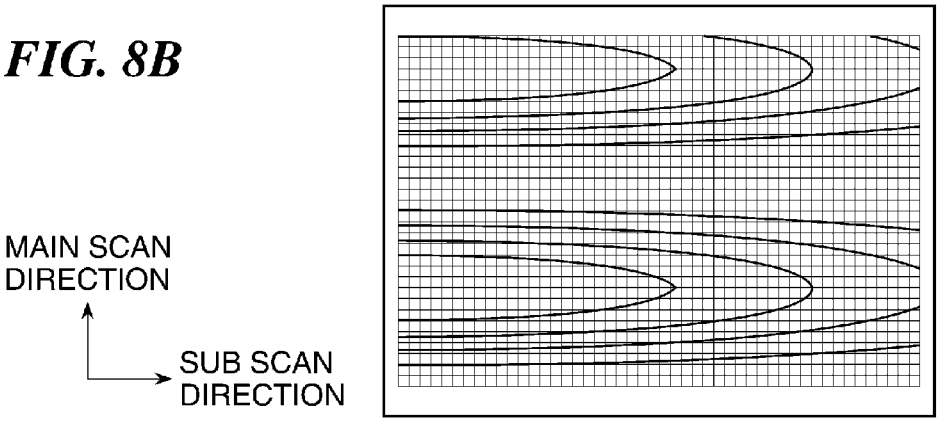
Figure 8C:
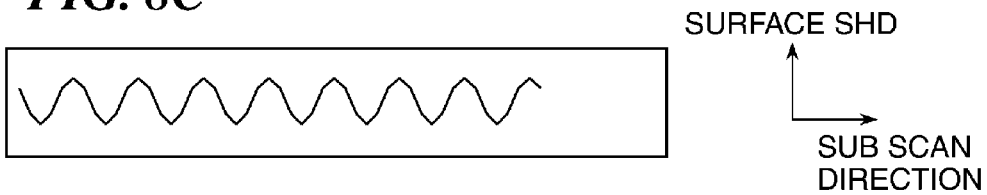
Figure 8D:
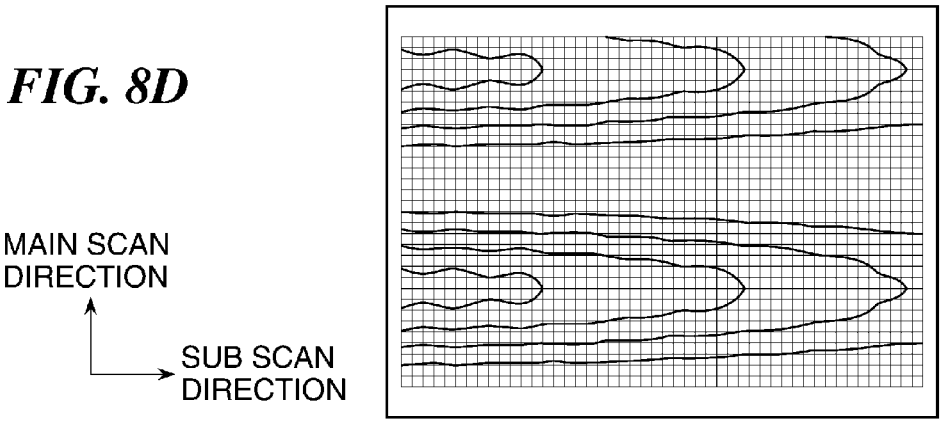

FIGS. 8A to 8D are diagrams useful in explaining an example of an image printed by the image forming apparatus shown in FIG. 1, in which FIG. 8A shows an example of a first profile corresponding to changes of the light amount of a laser beam A guided onto the photosensitive drum 102 in the main scan direction, and a second profile corresponding to changes of the light amount of a laser light B guided onto the photosensitive drum 102 in the main scan direction, FIG. 8B shows an example of a third profile indicative of non-uniformity in potential characteristics between a plurality of areas on the surface of one of the photosensitive drums, FIG. 8C shows an example of a fourth profile corresponding to non-uniformity in image density caused by a face tangle error on the rotary polygon mirror 202, and FIG. 8D shows an example of a correction profile generated by superimposing the third and fourth profiles.

In FIG. 8A, the first profile, denoted by reference numeral 121A, and the second profile, denoted by reference numeral 121B, (first correction data: density unevenness profile) are different because the laser beams A and B are different in emitted light distribution (emission angle) and light wavelength. A difference in density is caused by a difference in refractive index of a lens group (204 and 207) having power in the main scan direction and a difference in the light path over which each beam is guided by a mirror group (202, 205, 206, and 208). The density unevenness distribution is such that the density varies within a range of 10 percent in a cycle of approximately 40 mm or less with respect to 300 mm in the main scan direction, which means a gradual unevenness. The first profile 121A and the second profile 121B are used, as the first correction data, for correcting optical characteristics of the optical members in the main scan direction in which a plurality of light beams scan the photosensitive drum 102.

In FIG. 8B, the density unevenness within the image distributes in a longitudinal direction and a circumferential direction of the photosensitive drum, and the density varies within a range of 10 percent in a cycle of approximately 20 mm or less, which means a gradual unevenness. In this example, the final exposure sensitivity on the surface of the photosensitive drum is configured such that the difference in wavelength between the two lasers has minimum influence thereon.

In FIG. 8C, the density unevenness caused by a face tangle error appears in a cycle of five surfaces depending on one rotational cycle of the rotary polygon mirror 202 having five surfaces, such that unevenness in pitches between the sub scan lines appears as the density unevenness. Then, by superimposing the third and fourth profiles, the correction profile shown in FIG. 8D is obtained.

In the image forming apparatus shown in FIG. 1, to correct the above-described four image density unevennesses of three types, a nonvolatile memory is provided as an attachment to each replacement part which can cause an image density unevenness, and correction data is created and recorded in the nonvolatile memory by measuring correction profile data in advance after assembling the image forming apparatus at a factory. The image forming apparatus performs the correction using the correction data as described hereinafter during image creation.

Figure 9:
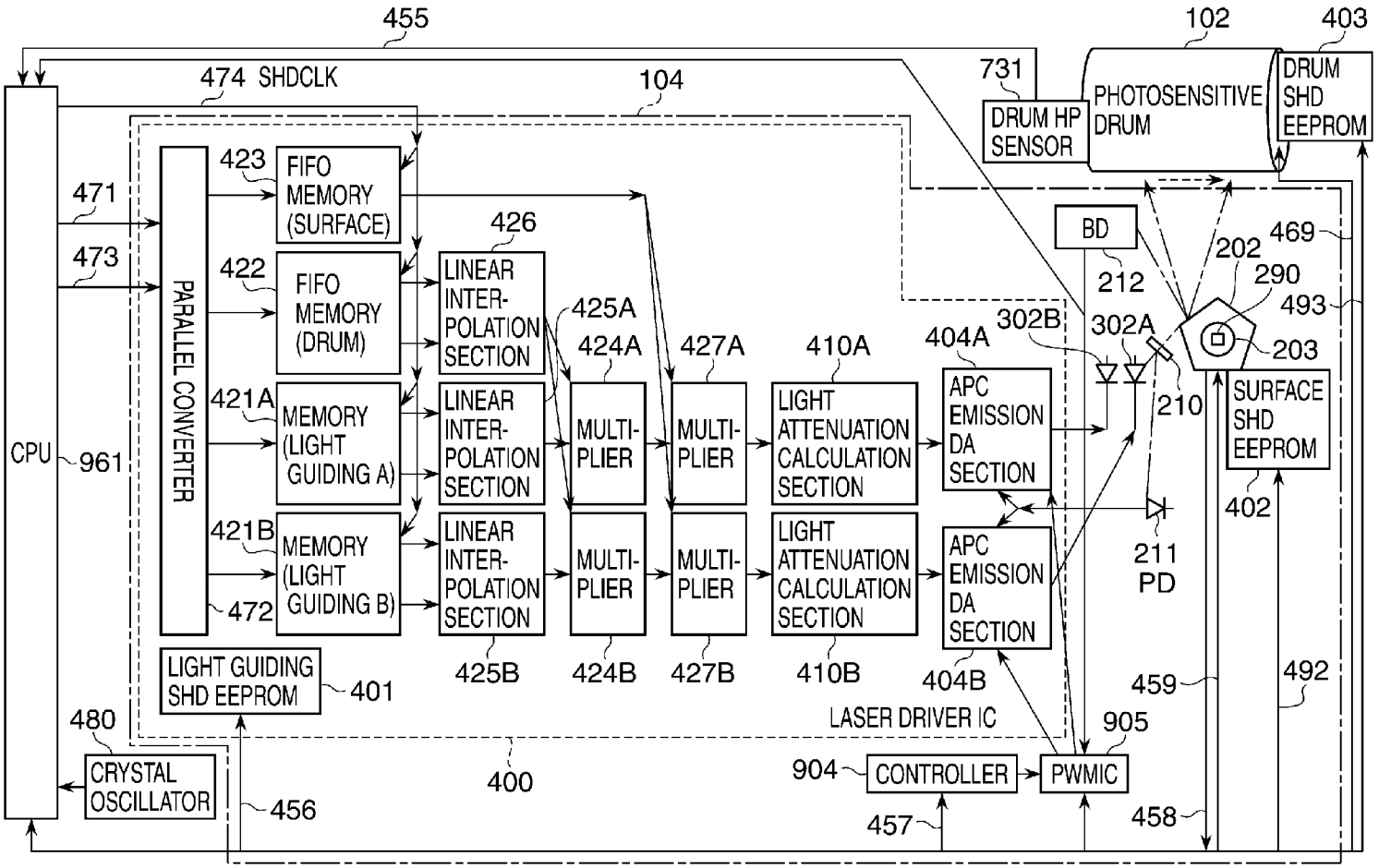
FIG. 9 is a block diagram of a control system used in the image forming apparatus shown in FIG. 1.

FIG. 9 is a block diagram of a control system used in the image forming apparatus shown in FIG. 1. The beam scanning devices (also referred to as the laser scanners) 104Y, 104M, 104C, and 104Bk have the same construction, and hence the suffixes Y, M, C, and Bk are omitted in the following description.

A CPU 961 is connected to the illustrated laser scanner 104, and the laser scanner 104 includes a printer image controller (hereinafter simply referred to as the controller) 904 and a laser driver IC 400. The CPU 961 is mounted on a body rear-side circuit board (not shown) separate from the circuit board 303, and performs the centralized control of the laser scanner 104 and the image forming apparatus, as mentioned hereinabove. Further, the CPU 961 is connected to the controller 904 by a serial communication line 457 so as to perform image engine control cooperatively in synchronism with each other at a command communication level. The CPU 961 is supplied with a 20-MHz operation clock signal from a crystal oscillator 480.

The controller 904 separates image data received from the outside of the image forming apparatus into four colors. Then, the controller 904 performs screen processing to convert the image data into bit map data having a laser-spot resolution, and controls a PWM IC 905 in synchronism with the BD signal to deliver a PWM light emission signal for flashing the 2-beam laser to the laser driver IC 400.

The laser driver IC 400 is mounted on the circuit board 303 and drives the semiconductor lasers (light sources) 302A and 302B. Further, the laser driver IC 400 is connected to the PD 211, and performs APC. The laser driver IC 400 drives the semiconductor lasers 302A and 302B according to the PWM light emission signal and performs control of the amount of light that illuminates the surface of the photosensitive drum and correction of the density unevenness with reference to a light amount set by APC.

The above-mentioned nonvolatile memory attached to the replacement part is a light guiding SHD EEPROM 401 provided in association with the first unevenness and second unevenness (in light guiding), which is included in the laser driver IC 400, and is connected to the CPU 961 by a serial communication line 456. The fourth unevenness is recorded in a surface SHD EEPROM 402 provided on the circuit board on which the polygon motor 203 is fixed. The surface SHD EEPROM 402 is connected to the CPU 961 by a serial communication line 492.

The third unevenness (second correction data) is stored in a drum SHD EEPROM 403 provided on the circuit board which is fixed to a unit of the photosensitive drum 102. The drum SHD EEPROM 403 is connected to the CPU 961 by a serial communication line 493. Note that the second correction data is created in association with each of the plurality of areas on the surface of the photosensitive member and is used for correcting potential characteristics of each area.

The illustrated control system has reference position signals associated with the correction profile, and the BD signal is used as the reference position signal with respect to the first unevenness and second unevenness in light guiding (first and second profiles: first correction data). Further, as for the fourth unevenness, a polygon surface identification signal generated with reference to the BD signal is used as a reference position signal. Further, as for the third unevenness, the BD signal used as a reference position signal for the main scan direction, and a drum HP signal input via a serial communication line 455 from a drum HP (home position) sensor (detection unit) 731 that detects a rotational position (also referred to as the rotational reference position) of one rotation of the photosensitive drum 102 is used as a reference position signal for the sub scan direction. Note that the operations of the CPU 961 and the laser driver IC 400 will be described hereinafter.

Figure 10:
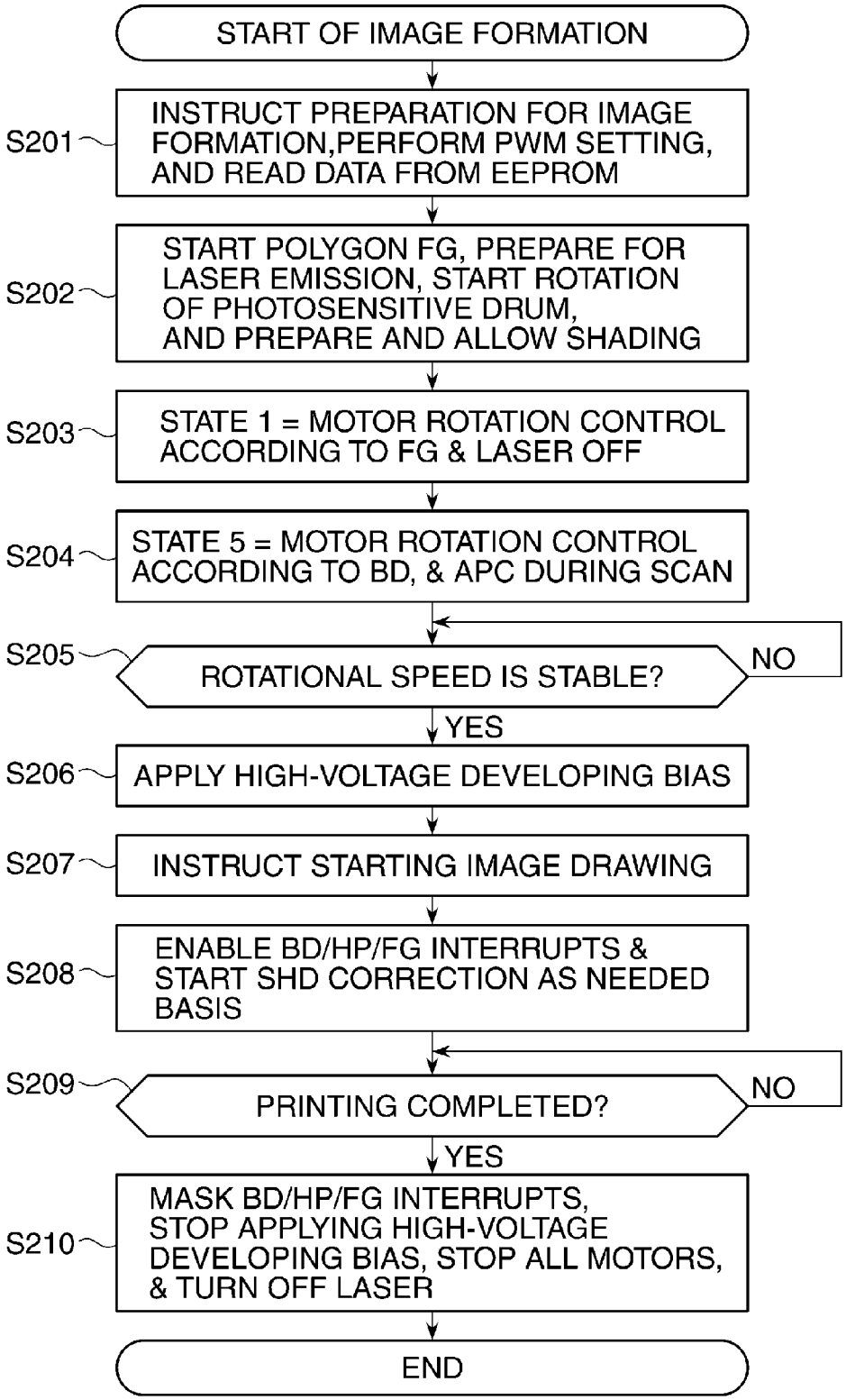
FIG. 10 is a flowchart of an image formation control process executed by a CPU appearing in FIG. 9.

FIG. 10 is a flowchart of an image formation control process executed by the CPU 961 appearing in FIG. 9.

First, when a print instruction is input from a console section (not shown) to the controller 904, the controller 904 sends an instruction for preparing for image formation to the CPU 961. Upon receipt of this instruction, the CPU 961 performs PWM setting, and reads out data from light guiding SHD EEPROM 401, the surface SHD EEPROM 402, and drum SHD EEPROM 403 (step S201).

Then, the CPU 961 drives the polygon motor 203 which is a DC motor to thereby drive the rotary polygon mirror 202 for rotation, and receives via a serial communication line 458 a rotational state detection signal (rotational position signal, hereinafter referred to as the FG (Frequency Generator) signal) which makes it possible to identify a specific mirror surface of a plurality of reflective surfaces (five surfaces in this example) from a motor driver IC (signal output unit) 290 incorporated in the polygon motor 203. The CPU 961 outputs a rotation instruction signal via a serial communication line 459 to the motor driver IC according to the FG signal. Upon receipt of the rotation instruction signal 459, the motor driver IC feedback-controls the polygon motor 203 to control the rotary polygon mirror 202 (deflection unit) to rotate at a predetermined rotational speed (step S202).

Further, in the step S202, the CPU 961 instructs the rotational operation of the photosensitive drum 102. In accordance with this instruction, the drum HP signal is input from the drum HP sensor 731 to the CPU 961 once per one rotation of the photosensitive drum 102. The CPU 961 identifies the rotational position of the photosensitive drum 102 using a timer function (referred to as the VCLK counter) for counting time with reference to the drum HP signal. Note that the time required for the photosensitive drum 102 to rotate once is e.g. approximately 800 msec.

Next, the CPU 961 prepares for execution of APC. The CPU 961 sends a control instruction for APC to the laser driver IC 400 via a register serial communication line 471. The laser driver IC 400 writes the received control instruction in an internal memory, not shown.

First, the CPU 961 performs register setting for the laser scanner 104 for setting an adjustment amount (APC light amount) of the maximum laser beam amount as a target. The CPU 961 reads out a register setting value from the light guiding SHD EEPROM 401. The register setting value is written in the light guiding SHD EEPROM 401 in advance when measurement and adjustment are performed in a factory during assembly of a unit of the laser scanner 104, such that a light amount at a position on an irradiated surface of the BD 212 becomes a predetermined light amount, as mentioned hereinabove. Then, the register setting value is held in the light guiding SHD EEPROM 401 as the adjustment amount of the unit of the laser scanner 104. Note that the preliminary setting for correction is performed on each laser beam by 8 bits for each register.

Further, the CPU 961 prepares for execution of the laser beam amount shading (laser beam amount modulation, hereinafter referred to as SHD) control. After the preparation, the CPU 961 waits for inputting of the reference position signals, for APC and SHD (step S202).

Now, when it is detected from the FG signal that the rotary polygon mirror 202 has reached the predetermined rotational speed, the CPU 961 instructs the laser driver IC 400 to start APC. Then, when APC feedback control of the semiconductor laser 302A has become stable, the semiconductor laser 302A becomes capable of emitting a laser beam having intensity high enough to acquire the BD signal, and the CPU 961 detects the BD signal.

Thereafter, the CPU 961 shifts to sequence emission control for performing APC of all lasers in the other area than the photosensitive drum area in main scan. This stabilizes the feedback control of the semiconductor laser 302B. In the photosensitive drum area in main scan (hereinafter referred to as the video area), although the CPU 961 performs light emission control according to the PWM light emission signal, the image data has not been transferred in the initial state (state 1), and hence the CPU 961 does not execute the laser emission (step S203).

Next, the CPU 961 shifts from the motor control based on the FG signal to the motor control based on the BD signal (state 5) (step S204). Then, the CPU 961 determines whether or not the rotational speed has become stable (step S205). If it is determined that the rotational speed is not stable (NO to the step S205), the CPU 961 waits for the rotational speed to become stable.

On the other hand, if it is determined that the rotational speed has become stable (YES to the step S205), the CPU 961 allows the developing device 105 to apply a high-voltage developing bias as a preparation to start image drawing (step S206).

Next, the CPU 961 instructs the controller 904 to start image drawing (step S207). Upon receipt of the instruction, the controller 904 starts image drawing according to the image data. At this time, the image data is transferred on a line-by-line basis from the controller 904 to the PWM IC 905 by BD synchronization with reference to the BD signal. The PWM IC 905 modulates the image data by laser PWM modulation on a pixel-by-pixel basis, and sends the modulated image data as a binary differential signal for the two lasers to APC emission DA sections 404A and 404B. The laser driver IC 400 sets the maximum light amount as APC light amount, and drives the semiconductor lasers 302A and 302B with current controlled to respective amounts obtained by subtracting amounts of electric current corresponding to amounts of light attenuation calculated by the light attenuation calculation sections 410A and 410B, from the APC light amount, respectively, to thereby cause emission of the laser beams. Note that paths along which the laser beams reach the photosensitive drum 102 and the BD 212 are described hereinabove with reference to FIG. 5.

After execution of the step S207, the CPU 961 permits respective interrupts based on the BD signal, the drum HP signal, and the FG signal, and starts SHD correction (step S208).

Next, the CPU 961 determines whether or not the printing of one page has been completed (step S209). If the printing of one page has not been completed (NO to the step S209), the CPU 961 waits.

On the other hand, if the printing of one page has been completed (YES to the step S209), the CPU 961 stops the motor and so on, and extinguishes the lasers. Further, the CPU 961 masks the interrupts based on the BD signal, the drum HP signal, and the FG signal, and stops applying the high-voltage developing bias (step S210), followed by terminating the present process.

Now, a description will be given of an SHD operation performed by the CPU 961 and the laser driver IC 400.

The overall SHD control is performed in the following six steps: (1) first step: preparation of correction data in the memory (first preparation operation); (2) second step: generation and inputting of the reference position signals (3) third step: identification of a scan position (i.e. exposure position) by counting time from inputting of the reference position signal; (4) fourth step: calculation and transfer of data outside the laser driver IC 400; (5) fifth step: calculation of data in a correcting position by the laser driver IC 400; and (6) sixth step: modulation of laser current during PWM light emission by the laser driver IC 400.

The first preparation operation is executed in the step S202. The CPU 961 and the laser driver IC 400 are connected to each other via a register communication interface, and a laser beam amount correction timing signal (shading clock signal, hereinafter referred to as the SHDCLK) is given from the CPU 961 to the laser driver IC 400 via a communication line 474. The CPU 961 reads out setting values for the first and second unevenness corrections (hereinafter referred to as light guiding SHD) from the light guiding SHD EEPROM 401. These setting values are written in the light guiding SHD EEPROM 401 in advance when measurement and adjustment are performed in a factory during assembly of a unit of the laser scanner 104 such that a light amount at a position on an irradiated surface corresponding to each image height becomes a predetermined light amount.

The setting values for light guiding SHD read out from the light guiding SHD EEPROM 401 are written in memories 421A and 421B of the laser driver IC 400 by the register serial communication line 471. The setting values are prepared for each of the semiconductor lasers 302A and 302B at intervals of 20 mm in the main scan direction such that one dot is represented by data of 8 bits/256 gradations, and light guiding SHD is performed for a total 34 registers using 17 data items of the prepared setting values.

The CPU 961 reads out setting values for the third unevenness correction (hereinafter referred to as drum SHD) from the drum SHD EEPROM 403. The setting values (adjusted amounts) are written in the drum EEPROM 403 in advance when measurement and adjustment are performed in a factory during assembly of a unit of the photosensitive drum 102 such that a light amount at a position on an irradiated surface defined by each image height and time counted from the time point of inputting of the drum HP signal via the signal communication line 455 becomes a predetermined light amount.

The setting values for drum SHD read out from the drum SHD EEPROM 403 are written in a drum SHD memory, not shown, of the CPU 961. The setting values are prepared for 33 dots in the main scan direction and 32 dots in the sub scan direction, at intervals of 10 mm in a two-dimensional grid-like pattern, and drum SHD is performed on each 8 bits of a total of 1056 registers, using associated data of 8 bits/256 gradations.

The CPU 961 reads out setting values (third correction data) for the fourth unevenness correction (hereinafter referred to as surface SHD) from the surface SHD EEPROM 402 (another storage unit). The setting values are written in the surface SHD EEPROM 402 in advance when measurement and adjustment are performed in a factory during assembly of a unit of the laser scanner 104 such that unevenness in density between adjacent surfaces of the polygon mirror 202, each defined by time counted from the time point of inputting of the FG signal via the serial communication line 458, is attenuated to a predetermined unevenness level.

A control instruction for executing surface SHD is written in a surface SHD memory, not shown, of the CPU 961. The setting values are prepared in number corresponding to the number of sub scan lines per one rotation of the polygon mirror. In the present embodiment, the polygon mirror 202 has five surfaces and two laser beams are used, and hence surface SHD is performed on each 8 bits of a total of 10 registers.

The CPU 961 performs drum motor control according to the HP signal from the drum HP sensor 731 to thereby control the photosensitive drum 102 to fixed speed rotation. That is, the CPU 961 performs the feedback control such that the repetition period of generation of the HP signal becomes stable such that it is constant. Further, when APC becomes stable, the CPU 961 controls the polygon motor 203 to fixed speed rotation. That is, the CPU 961 performs the feedback control such that the repetition period of generation of the BD signal by the BD 212 becomes substantially constant.

The CPU 961 outputs periodic signals for use in control of main scan and sub scan on the photosensitive drum 102 and a periodic signal for use in control of polygon rotation, using the drum HP signal and the BD signal as interrupt signals, and further using the FG signal as the polygon surface identification signal.

Figure 11A:
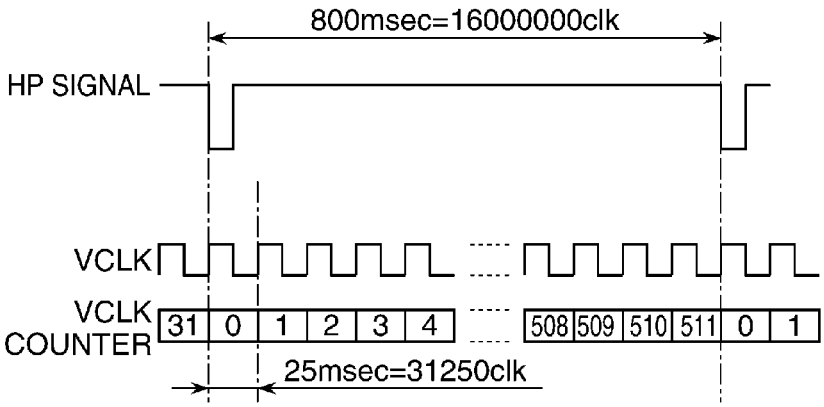
Figure 11B:
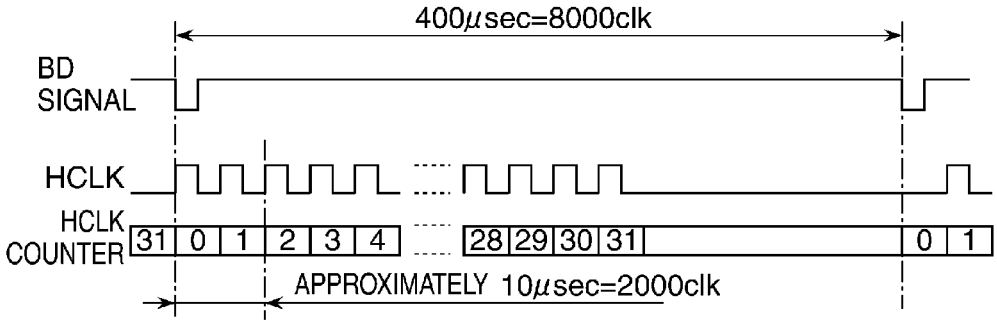
Figure 11C:
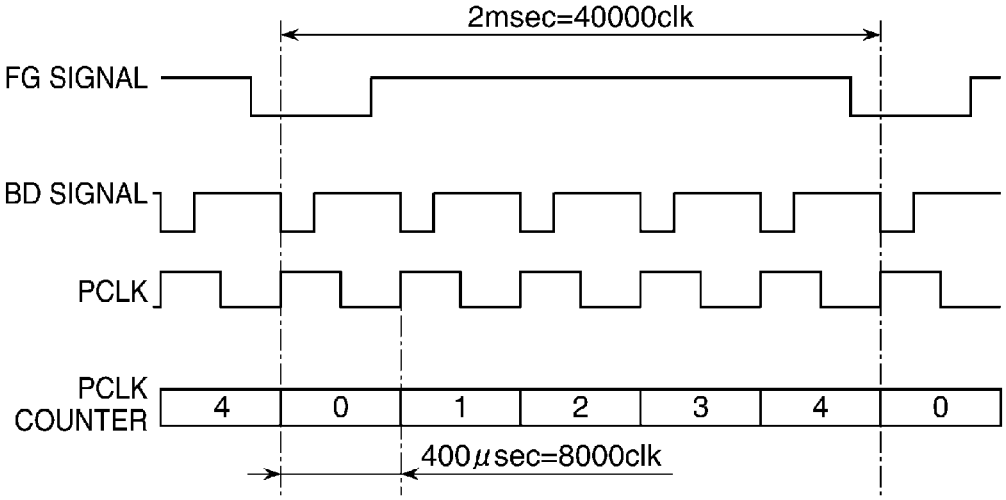

FIGS. 11A to 11C are diagrams useful in explaining the periodic signals output from the CPU 961 appearing in FIG. 9, in which FIG. 11A shows a drum counter clock signal as a periodic signal for control of sub scan on the photosensitive drum 102 (hereinafter referred to as the drum sub scan), FIG. 11B shows a drum counter clock signal as a periodic signal for control of main scan on the photosensitive drum 102 (hereinafter referred to as the drum main scan), and FIG. 11C shows a polygon surface counter clock signal as the periodic signal for control of polygon rotation.

The CPU 961 generates the drum counter clock signal (first clock signal of a predetermined frequency, hereinafter referred to as VCLK), shown in FIG. 11A, as the periodic signal for use in control of sub scan of the photosensitive drum 102. The CPU 961 resets the VCLK counter (first counter) with reference to a falling edge of the drum HP signal. Then, the CPU 961 generates a VCLK pulse at a repetition period of approximately 1.6 msec based on counting of a 20 MHz clock which is a crystal oscillation clock, not shown, from a predetermined first time to a predetermined second time during each scan.

The CPU 961 generates 512 pulses of VCLK (first clock signal) at equal intervals, which substantially correspond to one rotation of the photosensitive drum 102. Each number of pulses of VCLK indicates timing corresponding to each position on the photosensitive drum surface with respect to the drum HP signal.

Each pulse of VCLK corresponds to a positional unit of one step in a case where when the photosensitive drum 102 performs at a speed of one rotation per 800 msec, each of 32 block data items forming data corresponding to one rotation is divided into 16 divisional parts, and linear-interpolation of data is performed between each adjacent pair of divisional parts. One rotation of the photosensitive drum 102 corresponds to 16000000 counts, one block corresponds to 500000 counts, and one VCLK pulse corresponds to 31250 counts. This sub scan clock count of VCLK is counted up from 0 to 511 during one rotation of the photosensitive drum, and cyclically counted for each rotation of the photosensitive drum 102. Further, the CPU 961 latches the count value according to the BD signal, and hence the block for sub scan does not proceed during one main scan. The latched sub scan clock count value becomes a higher-order bit of an address read out from a two-dimensional drum memory (not shown).

The CPU 961 generates a drum counter clock signal (second clock signal of a predetermined frequency, hereinafter referred to as the HCLK), shown in FIG. 11B, as a periodic signal for control of main scan on the photosensitive drum 102. The CPU 961 first identifies a sub scan position on the drum surface from VCLK, and keeps one sub scan position during scan along the current scan line. Then, the CPU 961 resets the main scan position counter (second counter) with reference to a falling edge of the BD signal, and calculates drum SHD data on the drum surface during one scan. Note that the main scan position counter is counted up from 0 to 31 during one scan period of a laser beam, and the count value cycles for each one scan period.

The CPU 961 generates a polygon mirror surface counter clock signal (third clock signal of a predetermined frequency, hereinafter referred to as PCLK) as the periodic signal for control of polygon rotation, shown in FIG. 11C. The CPU 961 identifies which of the reflective surfaces of the polygon mirror the laser beam enters according to a falling edge of the FG signal and PCLK corresponding to a falling edge of the BD signal. The CPU 061 counts the polygon mirror surface counter clock signal, and the count value is counted up from 0 to 4 during one rotation of the polygon mirror 202, and cycles for each one rotation of the polygon mirror 202. The CPU 961 holds one surface information item for each laser during scan along one scan line.

The CPU 961 thus performs identification of each correction position for sub scan of the image forming apparatus by the SHD sequence, outside the laser driver IC 400.

Figure 12:
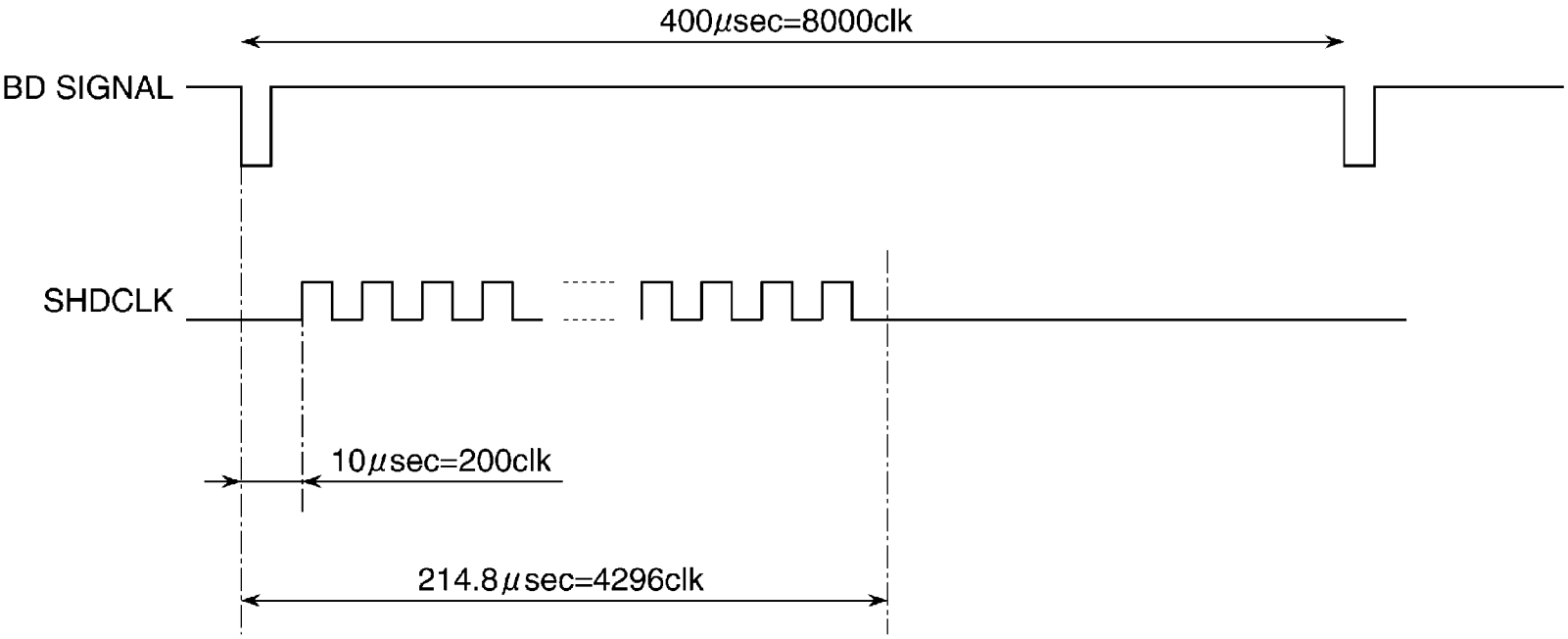
FIG. 12 is a diagram showing an example of a shading clock signal within one scan period of a laser beam.

FIG. 12 is a diagram showing an example of a shading clock signal during one multiple laser scan.

As a periodic signal for main scan, SHDCLK is used. The CPU 961 resets a counter, not shown, with reference to a falling edge of the BD signal. Then, the CPU 961 generates a SHDCLK pulse at a repetition period of approximately 0.4 μsec based on time counting by the crystal oscillation clock from the predetermined first time to the predetermined second time during one scan. The CPU 961 generates 512 pulses substantially corresponding to the video area according to a position associated with SHDCLK start timing and a position associated with SHDCLK end timing, and generates a total of 524 pulses, i.e. the 512 pulses and 12 pulses for adjustment, at equal intervals. Each number of pulses of SHDCLK indicates each timing at which the laser driver IC 400 performs calculation of a SHD correction position and calculation for SHD correction, and operates APC emission DA sections 404A and 404B, with respect to the BD signal.

More specifically, there are set in advance 400 μsec which is a BD period, serving as a reference, and 10 μsec and 214.8 μsec which are respective time periods to elapse after generation of the BD signal pulse and associated with the start position and end position of the video area, respectively, serving as references. The reference BD period and the time periods to elapse after generation of the BD signal pulse which define the video area are values as conditions for reproducing an optical unevenness position and a drum unevenness position, which were measured using a measurement tool in advance when the beam scanning device 104 and the photosensitive drum 102 were produced at a factory, and are defined in association with a period associated with data in each memory.

Thus, in SHD correction performed by the laser driver IC 400, each correction position in the main scan direction is identified.

Next, the CPU 961 transfers drum SHD data and surface SHD data as SHD correction data prepared outside the laser driver IC 400 (second correction data) to FIFO memories 422 and 423 of the laser driver IC 400, such that one row of SHD correction data for one scan is transferred on a one scan basis.

Figure 13:
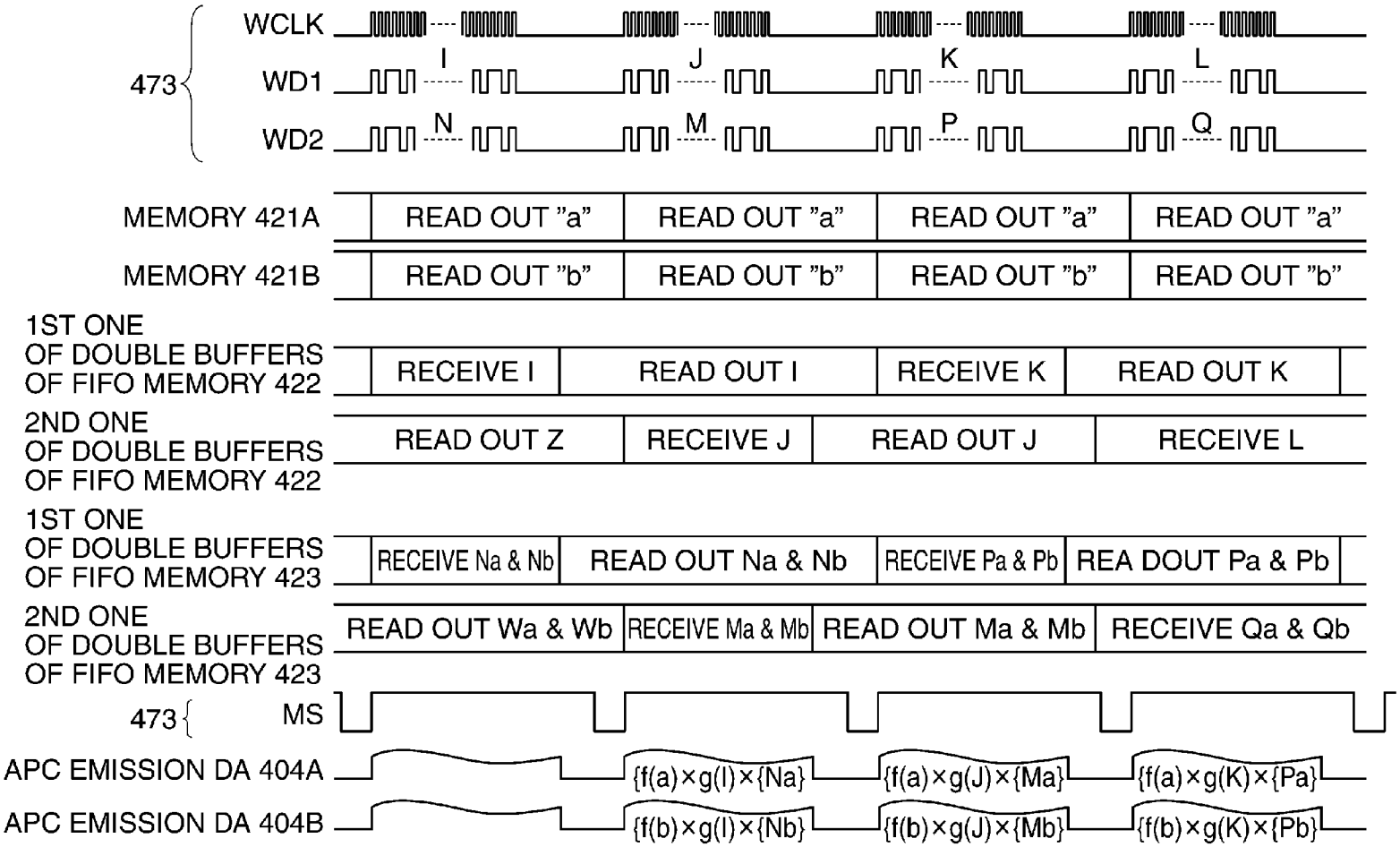
FIG. 13 is a diagram showing an example of correction data and light amount correction timing within one scan period of a laser beam.

FIG. 13 is a diagram showing an example of correction data and light amount correction timing during one multiple laser scan.

FIG. 13 shows the timings of signals over an unevenness correction data serial communication bus 473, and input and output of data to and from the FIFO memories 423 and 422, and the memories 421A and 421B, which are output from a parallel converter 472, and occurrence of the BD signal, and shows a state in which drum SHD data items Z, I, J, K, and L each for one scan, and surface SHD data items W, L, M, P, and Q each for one scan are alternately held in the associated memories. Further, light guiding SHD data items a and b for one scan are held in the memories 421A and 421B in advance by the first preparation operation.

Figure 14:
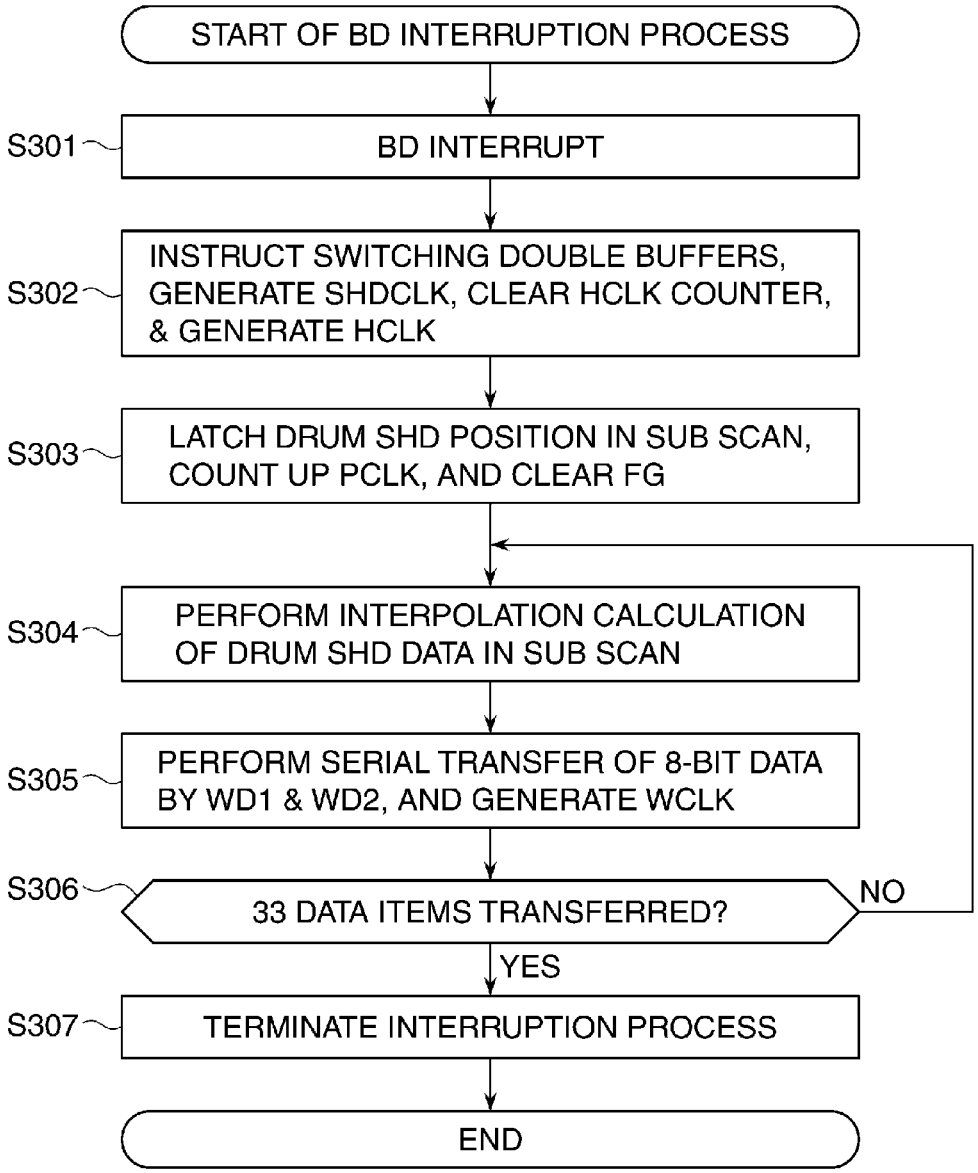
FIG. 14 is a flowchart of a BD interruption process executed by the CPU appearing in FIG. 9.

FIG. 14 is a flowchart of a BD interruption process executed by the CPU 961 appearing in FIG. 9.

The FIFO memories 422 and 423 are FIFO memories, and data is accumulated in the FIFO memories 422 and 423 in advance and are used for correction in a next scan line. Therefore, the laser driver IC 400 functions with respect to the sub scan position and the identified polygon surface, using data acquired in the preceding one scan. Further, it is only required to complete the transfer of the correction data for one scan line during the preceding one scan, and hence the data transfer is performed at the timing of serial computation by the CPU 961.

First, upon receipt of a BD signal, i.e. upon occurrence of a BD interrupt (step S301), the CPU 961 outputs an instruction for switching the duplicated memories (buffers) to the laser driver IC 400, and generates a SHDCLK pulse. Then, the CPU 961 clears a HCLK counter, not shown, and generates a HCLK pulse (step S302).

Then, the CPU 961 latches the sub scan position for drum SHD, counts up PCLK pulses using an internal counter (third counter), and clears the reference set by the FG signal (step S303). As described above, the CPU 961 first identifies a sub scan position on the drum surface from VCLK, and keeps the one sub scan position during scan on the current scan line. Then, the CPU 961 resets the main scan position counter with reference to a falling edge of the BD signal, and calculates drum SHD data on the drum surface during one scan.

At this time, the CPU 961 calculates one drum SHD correction data item by linear interpolation based on drum SHD correction data items on four points in the vicinity of a drum surface position identified by VCLK and HCLK (step S304). In parallel with this, the CPU 961 transfers two surface SHD correction data items for respective lasers, each formed of 8 bits and 16 bits in total, which are associated with one polygon surface of the polygon mirror 202 identified by PCLK, to the laser driver IC 400, in series by serial communication.

The unevenness correction data serial communication bus 473 used by communication for unevenness correction is formed by four signal lines, i.e. a line for a toggle signal for the FIFO memories 422 and 423 which are double buffer registers, a line for a clock signal, and two data lines (hereinafter referred to as MS, WCLK, WD1, and WD2, respectively). Transmission timings of the clock signal and two types of data transmitted via WCLK, WD1, and WD2, respectively, are illustrated in FIG. 13. WD1 transmit the drum SHD correction data of a total of 264 bits formed by 33 items of 8-bit data, which is associated with the video area for one scan according to the BD signal, to the laser driver IC 400.

WD2 transmits the aforementioned two surface SHD correction data items for respective lasers, each formed of 8 bits and 16 bits in total, which are associated with one polygon surface of the polygon mirror 202 identified by PCLK, to the laser driver IC 400. MS and WCLK transmit the toggle signal and the clock signal which are communication control signals common to WD1 and WD2.

In FIG. 13, the clock signal transmitted by WCLK indicates timings of generation of clock pulses having a frequency (8 MHz) which is eight times of that of HCLK which is necessary for data transfer by the serial data transfer. The toggle signal transmitted by MS is generated in synchronism with the BD signal, and according to a falling edge of a pulse of the toggle signal, a state of each of the double buffer registers (FIFO memories 422 and 423) is inverted.

As described above, the CPU 961 serially transfers 8-bit data by WD1 and WD2, and the clock signal by WCLK (step S305). For example, as shown in FIG. 13, each of drum SHD data groups I, J, K, and L, associated with respective four consecutive scans and each corresponding to one scan, which has been transferred via WD1, is buffered. Similarly, each of surface SHD data groups N, M, P, and Q, associated with respective four consecutive scans, each corresponding to one scan (of two lasers), which has been transferred via the WD2 signal line, is buffered. Then, the CPU 961 determines whether or not the above-mentioned 33 data items of one data group have been transferred (step S306). If the transfer of the 33 data items has not been completed (NO to the step S306), the CPU 961 continues to transfer the data. On the other hand, if the 33 data items have been transferred (YES to the step S306), the CPU 961 terminates the BD interruption process (step S307). Note that each surface SHD data group has a smaller data amount than the data amount of the 33 data items, and hence the termination of data transfer of the 33 data items is the termination of data transfer of these two kinds of data.

As described above, the CPU 961 transfers the SHD correction data in synchronism with each of the different 33 HCLK pulses. The CPU 961 performs the computation processing at a repetition period of approximately 1 μsec and transfers the data to the laser driver IC 400 by serial communication. The parallel converter 472 converts the 8-bit serial data into parallel data, and writes the converted data in the FIFO memories 423 and 422.

Figure 15:
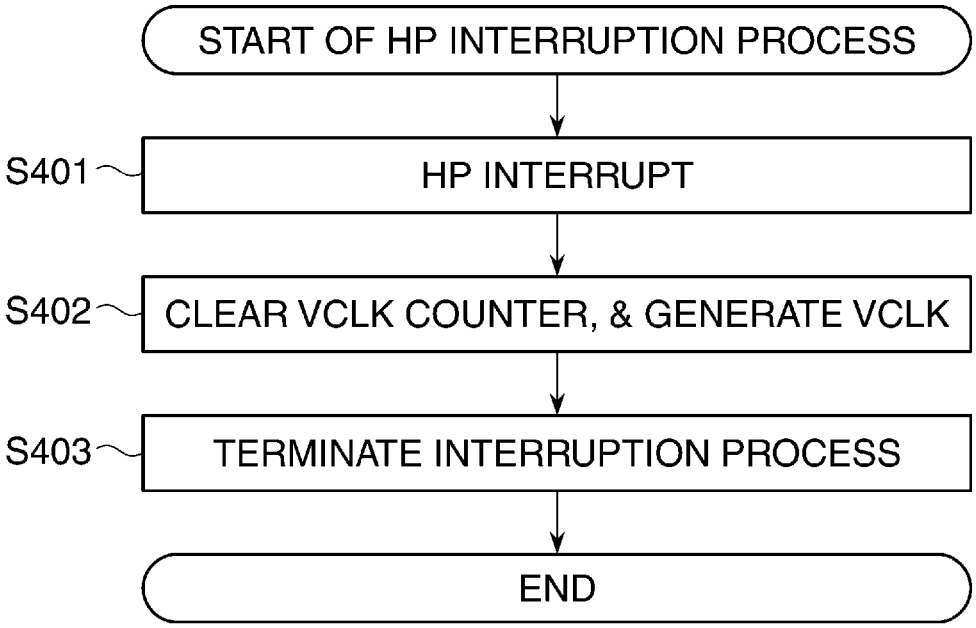
FIG. 15 is a flowchart of an HP interruption process executed by the CPU appearing in FIG. 9.

FIG. 15 is a flowchart of an HP interruption process executed by the CPU 961 appearing in FIG. 9.

Upon receipt of the drum HP signal, i.e. upon occurrence of an HP interrupt (step S401), the CPU 961 clears the VCLK counter, and generates a VCLK pulse (step S402). Then, the CPU 961 terminates the HP interruption process (step S403).

Next, a description will be given of data computation at each correction position, performed by the laser driver IC 400.

In the laser driver IC 400, the first data is read out from the FIFO memory 423 for the semiconductor laser 302A according to the timing of SHDCLK, and data items are read out from the FIFO memory 422 and the memory 421A. All the read data items are each handled as data of 8 bits/256 gradations in the following calculation. For example, as shown in FIG. 13, each of the drum SHD data groups I, J, K, and L, each corresponding to one scan, which has been transferred via WD1, is read out from the FIFO memory 422 with a delay of one scan. Similarly, each of the surface SHD data groups N, M, P, and Q for two lasers, each corresponding to one scan, which has been transferred via WD2, is read out from the FIFO memory 423 with a delay of one scan.

The data items read out from the FIFO memory 422 and the data items read out from the memory 421A are linear-interpolated by linear interpolation sections 426 and 425A, respectively. The linear interpolation section 426, first, selectively reads out two data items sandwiching the current position out of the 33 data items for the 32 blocks, from the FIFO memory 422. 16 SHDCLK pulses correspond to one block, and the linear interpolation section 426 calculates a linear-interpolated data item by 16-way linear interpolation based on its distance relationship with the two data items read out. For example, drum SHD linear-interpolated data calculated based on data I corresponding to one scan is denoted by g(I).

On the other hand, the linear interpolation section 425A selectively reads out two data items sandwiching the current position out of 17 data items for 16 blocks from the memory 421A. 32 SHDCLK pulses correspond to one block, and the linear interpolation section 425A calculates a linear-interpolated data item by 16-way linear interpolation based on a distance relationship with the two data items read out. For example, light guiding SHD linear-interpolated data for one laser calculated based on data "a" corresponding to one scan is denoted by a function f(a).

An output from the linear interpolation section 426 and an output from the linear interpolation section 425A are provided to a multiplier 424A, where the outputs are multiplied by each other. The surface SHD data read out from the FIFO memory 423 is formed by respective components for the lasers. For example, the components of the surface SHD data group N for each polygon surface are denoted by Na and Nb, with respective suffixes of "a" and "b" indicating associations with the semiconductor lasers 302A and 302B. An output (data) from the multiplier 424A and an output from the FIFO memory 423 are provided to a multiplier 427A, where the outputs are multiplied by each other. Then, one correction data item is output from the multiplier 427A. Then, the light attenuation calculation section 410A calculates an amount of light attenuation according to the output correction data.

This calculation is performed with respect to the 512 SHDCLK pulses indicative of timings corresponding to the 512 correction positions. Processing for reading data from the memory 421A and the FIFO memories 4422 and 423, and calculation processing executed by the linear interpolation sections 425A and 426 are performed by pipeline processing within a time corresponding to six SHDCLK pulses, and the processed data is delivered to the light attenuation calculation section 410A.

In this processing, in accordance with generation of a first SHDCLK pulse, the first data item is extracted from the correction profile and subjected to calculation, and then the amount of light emitted from the semiconductor laser 302A is corrected by changing a value set in the APC emission DA section 404A in accordance with generation of a sixth SHDCLK pulse calculated from the first SHDCLK pulse. Therefore, correction processing for a predetermined SHD position is started in accordance with six SHDCLK pulses before generation of a SHDCLK pulse corresponding to the predetermined SHD position in the main scan.

As for the semiconductor laser 302B, the second data read out from the FIFO memory 423 and data items read out from the FIFO memory 422 and the memory 421B are used. Then, the linear interpolation sections 426 and 425B, multipliers 424B and 427B, and the light attenuation calculation section 410B perform the same processing as performed for the semiconductor laser 302A.

As described hereinabove with reference to FIG. 7, a laser beam from the semiconductor laser 302B scans on the scanning surface along a scan line adjacent to a scan line of a laser beam from the semiconductor laser 302A with a delay of 42.3 μm, and hence the correction timing is delayed by a time corresponding to 42.3 μm. This amount of delay corresponds to six SHDCLK pulses, and hence the APC emission DA section 404B starts its operation after six SHDCLK pulses from the beginning of the video area.

Since the laser beam from the semiconductor laser 302B is also subjected to SHD correction in the video area similarly to the laser beam from the semiconductor laser 302A, six additional SHDCLK pulses are provided at the rearmost end, whereby the number of SHDCLK pulses after the adjustment is increased by six SHDCLK pulses before and after the predetermined laser scanning light amount correction timing.

Note that the laser current modulated by the PWM IC 905 is subjected to parallel processing by the APC emission DA sections 404A and 404B, whereby the correction operation is performed. For example, as shown in FIG. 13, the drum SHD data group I corresponding to one scan, transferred via WD1, and the surface SHD data group N for the two lasers corresponding to one scan, transferred via WD2 is read out from the respective associated FIFO memories (buffers) 422 and 423, with a delay of one scan, and subjected to the processing described hereinabove to give laser current modulation-based analog data expressed by the following equations:

correction DA value for APC emission DA section 404$A=\{f(a)\times g(I)\times Na\}$ correction DA value for APC emission DA section=$\{f(b)\times g(I)\times Nb\}$ Waveforms of correction DA (404A and 404B) shown in FIG. 13 are schematic representations of the correction DA values in which the vertical axis represents analog values.

The rising edge and falling edge of the analog value of the correction DA (404A) for the semiconductor laser 302A in each scan correspond to the timing of six SHDCLK pulses after the start of the SHD correction and the timing of six SHDCLK pulses before the termination of the SHD correction.

The rising edge and falling edge of the analog value of the correction DA (404B) for the semiconductor laser 302B in each scan correspond to the timing of 12 SHDCLK pulses after the start of the SHD correction and the termination of the SHD correction.

As described above, in the embodiment of the present invention, the SHD correction is enabled in the video area at a position corresponding to SHDCLK with reference to the APC light amount, and the laser beam amount correction data calculated by transferring the SHD correction data prepared and set in advance is made effective at a position corresponding to SHDCLK. As a result, it is possible to expose the image exposure area with a proper light amount in which all density unevennesses have been corrected.

As described above, according to the embodiment of the present invention, the correction profile is made appropriate for each unevenness correction target, and hence it is possible to reduce the memory capacity and reduce the amount of data transfer. Further, the first and second correction profiles for optical guiding unevenness are profiles specific to an individual unit of the beam scanning device 104, and are not changed between a plurality of scans. Therefore, by storing the data read from the light guiding SHD EEPROM 401, which is a nonvolatile memory, of the beam scanning device 104 in the memories 421A and 421B of the beam scanning device 104 by register serial communication in advance, it becomes unnecessary to transfer the SHD data items corresponding in number to the lasers, which makes it possible to simplify the unevenness correction data serial communication bus 473.

Further, the third correction profile for unevenness associated with the drum is a profile specific to an individual unit of the photosensitive drum 102, and is stored in the drum SHD EEPROM 403 outside the beam scanning device 104. Further, for the beam scanning device 104, it is made unnecessary to perform data transfer according to the number of multiple lasers, even in a case where the two-dimensional drum SHD correction is to be performed for all the lasers, and further it is made unnecessary to perform data transfer according to light guiding unevenness gradation even in a case where a large amount of correction data is required because the light guiding unevenness gradation is higher than two-dimensional drum SHD correction gradation. Therefore, it is unnecessary to transfer a large amount of data to the beam scanning device 104, which also makes it possible to simplify the unevenness correction data serial communication bus 473. Further, this eliminates the need to provide a large-capacity memory in the beam scanning device 104, which makes it possible to simplify the memory configuration.

In addition, the fourth correction profile for unevenness caused by a face tangle error is a profile specific to the number of surfaces of the polygon mirror 202, and is held in the surface SHD EEPROM 402 outside the laser driver IC 400. Further, superimposing calculation is performed by the laser driver IC 400, and hence it is not necessary to hold polygon mirror data items corresponding in number to the number of surfaces of the polygon mirror in the laser driver IC 400, which makes it possible to simplify the memory configuration of the laser driver IC 400.

As described above, the calculation sections which perform linear interpolation and superimposing calculation in shading correction are provided within or in the vicinity of the laser driver IC 400, whereby it is possible to integrate the calculation circuits into a circuit board or an IC, which makes it possible to realize the laser beam amount correction with high accuracy and low costs.

Although in the above-described embodiment, drum SHD is performed for the 32 blocks, and correction of the light guiding unevenness is performed for the 16 blocks, when the resolution of final correction control position is taken into consideration, it is easier to perform calculation when the correction resolution is an integer ratio.

Although in the above-described embodiment, the VCSEL having two laser emission devices has been described by way of example, an end emission laser other than the VCSEL may be used. Further, the present embodiment can be applied to a laser having three or more laser emission devices. The effects of cost reduction is greater as the number of laser emission devices is larger.

Although in the above-described embodiment, the description has been given of an example in which the three kinds of correction profiles for optical guiding unevenness, unevenness associated with the drum, and unevenness caused by a face tangle error are superposed, the present invention can be applied to a combination of dimensional unevenness profiles for four or more unevennesses, such as unevenness associated with the intermediate transfer belt, unevenness caused by vibration of an image driving unit, and unevenness in the high-voltage period for development. Further, the present invention can be also applied to a combination of profiles for drum shading and the multiple lasers. Particularly, when the transfer of profiles corresponding in number to the number of beams from the multiple lasers is simplified, the large advantageous effects are obtained, and it is possible to correct the laser beam amount at low costs.

Although in the above-described embodiment, the repetition period of the drum SHD is set to 10 mm, and the repetition period of light guiding unevenness is set to 20 mm, these are not limitative, unevenness-associated repetition periods other than these may be set, and the interpolation calculation and the superimposing calculation make it is possible to perform smooth laser beam amount correction with reduced steps of light amount.

Although in the above-described embodiment, the light guiding SHD EEPROM 401 used for storing the light guiding unevenness profiles is provided within the laser driver IC 400, the EEPROM may be provided outside the laser driver IC 400 insofar as the light guiding SHD EEPROM 401 is mounted in parallel with the laser driver IC 400 on the same component unit or circuit board unit as an assembly unit of the beam scanning device 104 or a component unit to be replaced for maintenance.

Although in the above-described embodiment, the surface SHD EEPROM 402 used for storing the face tangle error-caused unevenness profile is provided within the polygon motor 203, the surface SHD EEPROM 402 may be provided outside the polygon motor 203 insofar as the surface SHD EEPROM 402 is mounted in parallel with the polygon motor 203 on the same component unit or beam scanning device unit as an assembly unit of the beam scanning device 104 or a component unit to be replaced for maintenance purpose. Further, one EEPROM may be shared as the EEPROM associated with the light guiding unevenness profile and the face tangle error-caused unevenness profile.

Although in the above-described embodiment, the description has been given of the color image forming apparatus and the beam scanning device provided in the color image forming apparatus by way of example, the image forming apparatus is not limited to the color image forming apparatus, but may be a monochrome image forming apparatus which performs image formation in black and white, and a beam scanning device included in the monochrome image forming apparatus.

As is clear from the above description, in the example illustrated in FIG. 9, the CPU 961 functions as an output unit and a calculation unit, and the laser driver IC 400 functions as a control unit. Further, the drum HP sensor 731, the BD 212, and the CPU 961 function as an identification unit. Further, the crystal oscillator 480 and the CPU 961 function as a signal generation unit While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, a control method based on the functions of the above-described embodiment may be caused to be executed by the beam scanning device and the control unit provided outside the beam scanning device.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

This application claims the benefit of Japanese Patent Application No. 2012-102875, filed Apr. 27, 2012, and Japanese Patent Application No. 2013-086665, filed Apr. 17, 2013, which are hereby incorporated by reference herein in their entirety.

What is claimed is:

1. An image forming apparatus comprising:

a photosensitive member;

a beam scanning device including:

a plurality of light sources configured to emit light beams for exposing the photosensitive member;

a rotary polygon mirror configured to deflect a plurality of light beams emitted from the plurality of light sources and scan the photosensitive member;

an optical member configured to guide the plurality of light beams deflected by the rotary polygon mirror to the photosensitive member;

a storage unit configured to store first correction data for correcting a light amount of the light beam;

a control unit; and a housing to which the plurality of light sources, the storage unit, and the control unit are attached, wherein the storage unit outputs the first correction data to the control unit, and wherein the first correction data includes a plurality of data items respectively corresponding to the plurality of light sources and first data for correcting changes of the light amount of each of the light beams caused by optical characteristics of the optical member; and an output unit disposed to the image forming apparatus separately from the beam scanning apparatus, connected to the control unit from outside of the housing via a communication bus, and configured to output second correction data for correcting the light amount of the light beam to the beam scanning device via the communication bus, wherein the second correction data is data for being commonly used in correction of the light amount of the light beam emitted from each of the plurality of light sources and includes second data associated with non-uniformity in potential characteristics of each of a plurality of areas on a surface of the photosensitive member, and wherein the control unit is configured to control the light amount of the light beam to be emitted from each of the plurality of light sources, based on the first correction data stored in the storage unit, and the second correction data output from the output unit.

2. The image forming apparatus according to claim 1, wherein the first data is for correcting changes of the light amount of each of the light beams in a scanning direction in which the light beam scans the photosensitive member, caused by the optical characteristics of the optical member.

3. The image forming apparatus according to claim 1, wherein:

the second data is for correcting the light amount of the light beam for each of a plurality of reflective surfaces of the rotary polygon mirror, the beam scanning device includes another storage unit configured to store the second data, the output unit reads out the third data from said another storage unit.

4. The image forming apparatus according to claim 3, further comprising:

a signal generation unit configured to generate a clock signal of a predetermined frequency;

a signal output unit configured to output a rotational position signal corresponding to a rotational position of the rotary polygon mirror; and an identification unit that includes a counter configured to start counting the clock signal according to output of the rotational position signal from the signal output unit, and is configured to identify, based on a count value of the counter, a reflective surface, among the plurality of reflective surfaces, where the plurality of light beams enter, wherein said another storage unit outputs one of second data items each for correcting the light amount of the light beam in association with each of the plurality of reflective surfaces of the rotary polygon mirror, which is associated with the reflective surface identified by the identification unit.

5. The image forming apparatus according to claim 1, further comprising:

an identification unit configured to identify an exposure position on the photosensitive member to be exposed with the plurality of light beams emitted from the plurality of light sources, wherein the output unit outputs the second correction data associated with the exposure position to the beam scanning device based on the exposure position identified by the identification unit.

6. The image forming apparatus according to claim 5, further comprising:

a signal generation unit configured to generate a first clock signal of a predetermined frequency, wherein the identification unit includes:

a detection unit configured to detect a rotational reference position set to the photosensitive member; and a counter configured to start counting the first clock signal according to detection of the rotational reference position, and wherein the identification unit identifies the exposure position to be exposed with the light beams emitted from the plurality of light sources in a direction of rotation of the photosensitive member based on a count value of the counter.

7. The image forming apparatus according to claim 5, further comprising:

a signal generation unit configured to generate a clock signal of a predetermined frequency; and a light receiving unit configured to receive a light beam deflected by the rotary polygon mirror, wherein the identification unit includes a counter configured to start counting the clock signal according to reception of the light beam by the light receiving unit, and identifies the exposure position to be exposed with the light beams emitted from the plurality of light sources in the scanning direction based on a count value of the counter.

8. The image forming apparatus according to claim 1, wherein each of the plurality of light sources is a light emitting element including a vertical cavity surface emitting laser.

9. The image forming apparatus according to claim 1, wherein:

the beam scanning device includes a circuit board, wherein each of the plurality of light sources is a light emitting element including a semiconductor laser, and wherein each of the semiconductor laser and the control unit is mounted on the circuit board.

10. The image forming apparatus according to claim 9, wherein the semiconductor laser is a vertical cavity surface emitting laser.

11. The image forming apparatus according to claim 9, wherein:

the beam scanning device includes an optical box that accommodates the rotary polygon mirror and the optical member, and the circuit board is attached to the optical box.

* * * * *